US005133205A

United States Patent [19]

Rostik et al.

[11] Patent Number: 5,133,205

[45] Date of Patent: Jul. 28, 1992

[54] SYSTEM AND PROCESS FOR FORMING THIN FLAT HOT ROLLED STEEL STRIP

[75] Inventors: Libor F. Rostik, Duncanville; Lloyd M. Schmelzle, Desoto, both of Tex.; Peter Fink, Juistweg; Dieter Figge, Defreggerstra{e, both of Fed. Rep. of Germany

[73] Assignees: Mannesmann Aktiengesellschaft, Dusseldorf, Fed. Rep. of Germany; Chaparral Steel Company, Midlothian, Tex.

[21] Appl. No.: 612,420

[22] Filed: Nov. 13, 1990

[51] Int. Cl.[5] ..... B21B 27/06

[52] U.S. Cl. ..... 72/200; 72/202; 72/190; 72/364

[58] Field of Search ..... 72/364, 200, 202, 187, 72/190; 29/527.7; 164/476

[56] References Cited

U.S. PATENT DOCUMENTS

| | | | |
|---|---|---|---|
| 1,360,959 | 11/1920 | Kriwan | 72/243.6 |
| 2,709,934 | 6/1955 | Platzer . | |
| 2,932,997 | 4/1960 | Sendzimir . | |
| 2,960,894 | 11/1960 | Platzer . | |
| 2,975,663 | 3/1961 | Platzer . | |
| 2,978,933 | 4/1961 | Sendzimir . | |
| 3,049,948 | 8/1962 | Sendzimir . | |
| 3,076,360 | 2/1963 | Sendzimir . | |
| 3,079,975 | 3/1963 | Sendzimir . | |
| 3,138,979 | 6/1964 | Sendzimir . | |
| 3,147,648 | 9/1964 | Sendzimir . | |
| 3,210,981 | 10/1965 | Sendzimir . | |
| 3,587,268 | 6/1971 | Bricmont et al. | 72/202 |
| 3,959,999 | 6/1976 | Filatov et al. | 72/200 |

FOREIGN PATENT DOCUMENTS

| | | | |
|---|---|---|---|
| 0045958 | 2/1982 | European Pat. Off. | 72/364 |
| 0306076 | 8/1988 | European Pat. Off. . | |
| 0150853 | 9/1981 | Fed. Rep. of Germany | 72/200 |
| 55-0024935 | 2/1980 | Japan | 72/200 |
| 58-0016707 | 1/1983 | Japan | 72/200 |
| 58-0221602 | 12/1983 | Japan | 72/200 |
| 0728955 | 4/1980 | U.S.S.R. | 72/200 |

OTHER PUBLICATIONS

Muenker et al., *Krupp/Platzer Planetary Mill*, "Evolution, Design and Operating Experience in Ferrous and Non-Ferrous Practice", (Feb. 1969).

Fink et al., "Economic Application of the Krupp/-Platzer Planetary Mill for the Production of Hot Rolled Strip", *Iron and Steel Engineer, (Jan. 1971) p. 45.*

*Krupp/Platzer Planetary Mill with Thickness Reduction of up to 98%*, (1987).

Sendzimir, "Hot Strip Mills for Thin Slab Continuous Casting Systems", *Iron and Steel Engineer*, (Oct. 1986), p. 36.

Buch and Fink, Continuous thin slab casting—direct rolling. Why the planetary hot strip mill Iron and Steel Society, Inc., 4th Advanced Technology Symposium "Project 2000".

Near Net Shape Casting, The first Encounter. May 10-12, 1987 (Myrtle Beach, SC), with type-off of film narration.

*Primary Examiner*—Lowell A. Larson
*Assistant Examiner*—Michael J. McKeon
*Attorney, Agent, or Firm*—Jones, Day, Reavis & Pogue

[57] ABSTRACT

A continuous process and system for making flat rolled steel or ferrous metal strip having a minimum thickness sufficient to allow substantially direct product manufacture therefrom, wherein a Platzer planetary mill continuously receives an as-continuously cast endless slab of steel or ferrous metal and effects a first reduction in thickness from the as-continuously cast thickness of the slab, a plurality of millstands sequentially receive the continuous strip from the Platzer planetary mill to effect a second reduction in thickness of at least about 50% of the first reduced thickness to provide a continuous strip having an average thickness of less than about 1.8 mm, and electric induction reheaters are placed between each adjacent pair of millstands to maintain the continuous strip at a working temperature sufficient to effect the second reduction in thickness.

27 Claims, 18 Drawing Sheets

Fig.4G
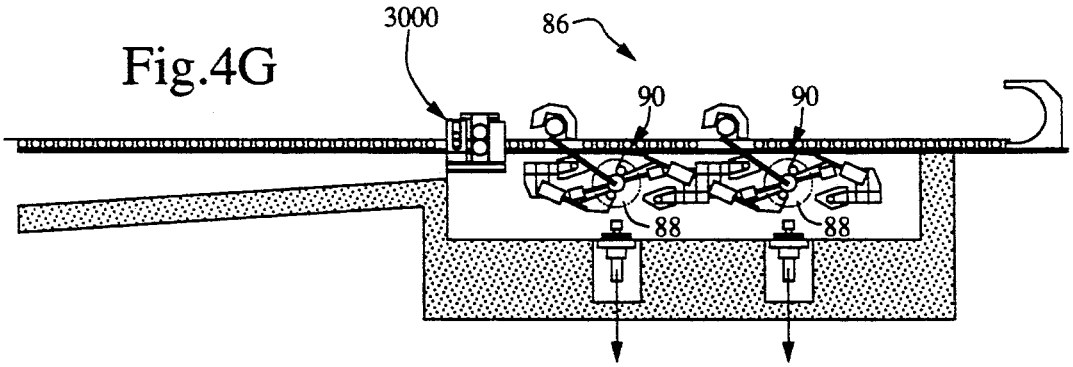
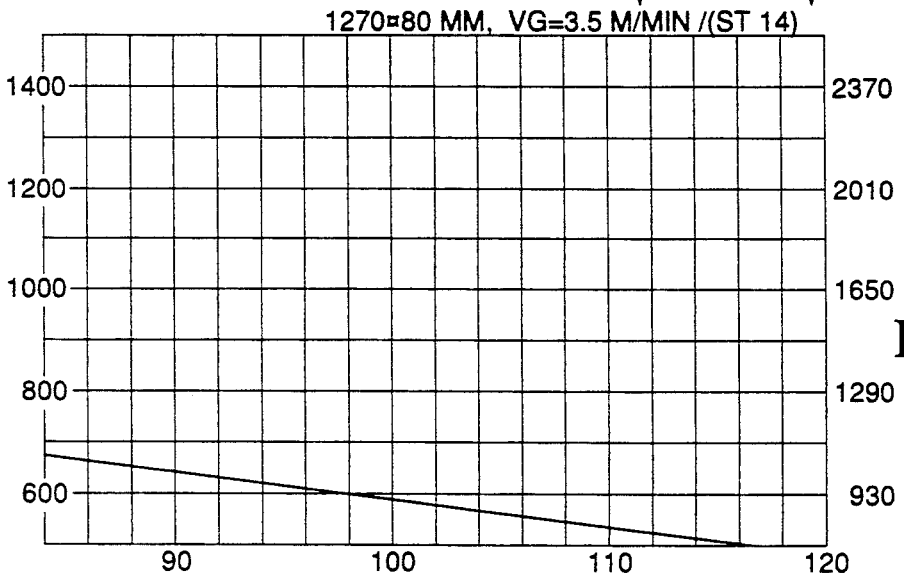
Fig.4H
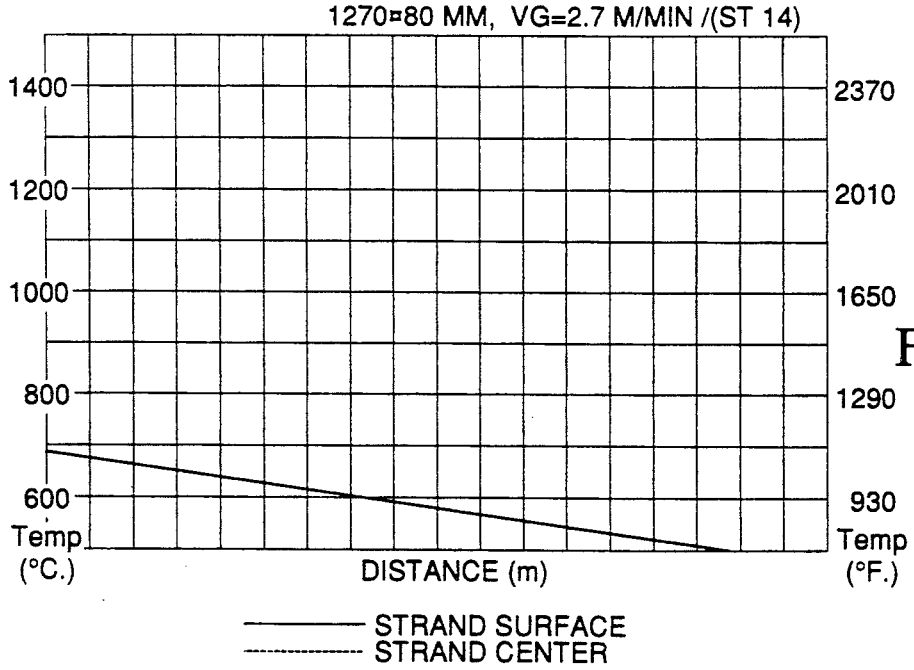
Fig.4I 80
9.273

80
R20
90.0°
R20
9.273
20

80
120°
80°
R20
9.273
27

80
1250
120°
R20

SYSTEM AND PROCESS FOR FORMING THIN FLAT HOT ROLLED STEEL STRIP

FIELD OF THE INVENTION

The present invention relates to a system and process for making thin steel strip, and, in particular, relates to a system and process for continuously forming a continuous thin flat hot rolled steel strip having a finished thickness less than about 1.8 mm utilizing an as-continuously cast endless slab of steel.

BACKGROUND OF THE INVENTION

There are many known methods of forming and shaping steel. One method is to utilize a process known as continuous casting. This process, wherein liquid steel is poured directly into semi-finished shapes such as slabs, blooms, blanks or billets, is continuing to expand in its applications because, among other things, it eliminates or reduces the need for certain steelmaking equipment, compared to traditional casting of steel into ingots and later processing to desired products.

In the prior art, the continuous casting process produced a slab of steel from 150 to 300 mm thick and having a width up to 3,000 mm. These slabs were cut into pieces, of varying lengths, dependant upon process particulars. To produce .a flat rolled steel strip from that material, the discrete slab was reheated, passed through one or more hot rolling roughing millstands, and then passed through one or more hot rolling millstands that further reduced the thickness to approximately 2.5 mm. If necessary, it was then passed through at least one, usually several, reducing/finishing cold rolling millstands to obtain further reduction in thickness.

As the strip of steel got thinner in the hot rolling portion of the prior art process, it was difficult to get it to enter a millstand for further reduction in thickness. The steel strip entered each of the millstands at low speed and then was accelerated. It was important to try to access the tail end of the strip as fast as possible because that portion was the coldest by the time it entered the hot rolling millstands.

The need for creating discrete slabs from the as-continuously cast slab was definite and unavoidable, because of the entry and exit speeds of the various dissimilar types of apparatus combined into prior art systems. The known hot rolling millstand technology was not capable of speed-matching the roughing and finish millstands to the continuous output speed of known continuous casting apparatus, thereby preventing fully continuous operation. The required high speeds of the hot rolling mill, necessary particularly to avoid fire-cracking of the rolls and minimize heat loss, simply could not be matched up with prior devices by those skilled in the steelmaking art.

One of the problems in the system barring further reduction was that the hot steel strip became extremely difficult to control if it moved too fast from one process station to the next. A further difficulty of the discrete hot slab processes lay in threading the roll gap between the millstand rolls, which operation needed to be carried out for .each discrete slab. It required the opening of all of the millstands and then sequentially closing each stand, from the tail end of the slab towards the head or front end of the slab, until all were closed. Because of the heat loss occurring throughout each discrete slab, continued acceleration of the stands to effect rolling at a higher than desired hot rolling steady state speed was required to effect reduction before heat loss reached the point of non-workability of the steel.

The heat loss from the discrete slab was a serious problem because the tail end cooled rapidly, and often was below optimum hot rolling temperatures before it reached the last several millstands. To minimize this problem, the hot rolling millstands had to have said ability to constantly accelerate or, stated colloquially, to "zoom." Roughly speaking, the discrete slab had to enter each millstand at a very low speed, then be accelerated as quickly as possible to a speed in excess of desired hot rolling speed. The rapid acceleration or "zoom" was practiced to attempt to access the tail end of the discrete strip through all of the hot rolling mills as rapidly as possible, to even out any temperature drop and avoid heat loss to a level where the metal would be unworkable. For each millstand to "zoom", electric motors of horsepower and speed well above that required if a fully continuous, steady state hot rolling process could have been practiced, proved necessary. The use of a coil box, upstream of the first millstand, to provide a heat-retaining environment minimizing tail end cooling and cutting back the .level of acceleration required by the millstands, was the best solution afforded by the prior art to the need for "zooming." The capital costs of the coil box, however, offset any savings in electric motor costs, and the operating costs for utilities, though somewhat less, were still in excess of desired or acceptable limits.

The threading technique also required skill in manipulating. The speed of each discrete strip down the line, particularly after several of the stands had been closed and were "zooming" and taking their designed reductions.

While the theoretical minimum for strip thickness could be less than 1.5 mm, the substantial shortcomings in the prior art made the achievable hot rolled thickness no less than, at best, 1.8 mm to 2.5 mm. For applications requiring thinner gauges, the steel, after completion of hot rolling, had to be annealed, pickled and then cold rolled to the final thickness, additional processes that were time and energy consuming, and required substantial capital expenditures.

A general description of the relationship of continuous casting devices and rolling mills appears in"Rolling Mills Shape Up ", Iron Age (August 1990), p. 16 [which publication and its disclosures are not prior art to this invention].

A number of configurations of continuous casting devices and rolling mills were experimented with, in an attempt to develop a fully continuous casting-to-finished thin flat hot rolled steel strip process. Among the various mill configurations looked to for roughing levels of reduction were the planetary mill type, so-called because the work rolls orbited around a support structure of some particular configuration.

A planetary mill known as a "Platzer planetary mill" was developed in the late fifties and early sixties. It is generally described in U.S. Pat. Nos. 2,975,663; 2,960,894; and 2,709,934. The Platzer planetary mill is a force-fed mill having drive rollers that can accept a steel slab having a thickness of 50 to 100 mm and reduce it in thickness with planetary organized rolls to approximately a thickness of from 20 mm to about 3 to 6 mm. It was never a commercially successful device, mainly due to the fact that continuous casting of 50 to 100 mm thick slab was not achievable.

The prior art techniques for feeding the Platzer planetary .mill also presented serious shortcomings. When the thick, discrete slabs which were available from known continuous casting techniques were used, the force-feeding into the Platzer planetary mill created a large feed tongue or leading edge of steel strip, both initially and as the mill was screwed (adjusted) down to the final desired reduction. It was necessary to discard this feed tongue, usually by torch-cutting it free from the front end of the strip and discarding it upwardly, downwardly or transversely from the process line. The amount of metal wasted from each slab with respect to rolled strip product, although recycled into the melt end of the process, was substantial, particularly when related utilities, capital and operating costs were factored in.

Suggested prior combinations of continuous casting devices with Platzer mills, to comprise a hot steel strip system, did not include continuous hot rolling mill technology as part of the combination. For example, the Krupp/Platzer planetary mill, when combined with a continuous casting device, provided a hot strip mill with single pass thickness reduction of up to 98%. Muenker et al., *Krupp/Platzer Planetary Mill*, "Evolution, Design and Operating Experience in Ferrous and Non-Ferrous Practice" (February 1969); Fink, et al., "Economic Application of the Krupp/Platzer Planetary Mill For the Production of Hot Rolled Strip," *Iron and Steel Engineer*, January 1971, p. 45; *Krupp/Platzer Planetary Mill—A Hot Strip Mill With Thickness Reduction of up to* 98% (1987). The mill disclosed comprised a conventional continuous casting process allegedly configured for thin slab casting, which fed the as-cast slabs through conventional straightening rolls into a tunnel-type holding furnace. The as-cast slabs exited the holding furnace and passed into/were fed to the rolling gap of a Platzer planetary mill. (Usually, primary descaling would precede the feed rollers, with secondary descaling preceding the passing into/feeding into the Platzer planetary mill.) The Platzer planetary mill would reduce, in a single pass, the feed slab from its starting, as-cast and straightened thickness, up to 98%, to finished thickness. The resulting high reduction rolled steel strip was discharged from the mill onto a roller table by a standard pinch roll stand, which maintained tension between the roll gap and the pinch rolls. Cutting and coiling with conventional down-coiler units completed the disclosed process.

As an alternative to this arrangement, the Platzer planetary mill would reduce the feed slab from its starting, as-cast and straightened thickness, up to 98%. Instead of being discharged from the Platzer mill through a standard pinch roll stand/tension roller combination, the alternative configuration would utilize one or two (2) four-high finish millstands, particularly millstands fitted with Krupp IGC roll gap control system, disclosed to improve flatness and achieve close tolerances. No additional sources of heat to the steel strip were provided when the one or two (2) four-high finish millstands configuration were supplied, such that any possible finish reduction could not have been substantial because retained heat was inadequate.

The Muenker et al. article described in greater detail a portion of a configuration of a Platzer planetary mill combined with one or two (2) finishing mills, but not teaching the use of such configuration in combination with an as-continuously cast endless slab; Muenker et al. disclosed such mills for use only with discrete slabs. Muenker et al. described this alternative configuration as useful in a large tonnage situation, where the Platzer planetary mill served as a roughing millstand. FIG. 15 and the accompanying text compared a conventional hot rolling mill, utilizing twelve (12) horizontal and six (6) vertical stands, with a Platzer planetary mill roughing stand/finishing train comprising six (6) horizontal and two (2) vertical stands, both giving production rates of 150 tons/hour (pages 8–10; FIG. 15). Munker et al. disclosed the output dimension from the Platzer planetary mill of rough strip having a thickness of 10 to 20 mm.

Fink et al. addressed the use of a Platzer planetary mill in combination with a continuous slab caster and various downstream rolling devices. In the combination of continuous slab caster and Platzer planetary mill discussed there, Fink et al. noted that the feed rolls, used to force the individual abutted or discrete continuously cast slabs into the Platzer mill (p. 48), would take a 20% reduction, with the mill then taking an 80 to 98% reduction in one pass, depending upon the final thickness required. FIG. 4VI illustrated a furnace-planetary mill combination, again with the Platzer planetary mill being operated as a roughing millstand upstream of a five (5) to seven (7) stand finishing train, consisting of an undefined number of vertical and horizontal finishing millstands.

Besides the Platzer planetary rolling mill, the only other such mill used on a commercial scale was the Sendzimir planetary mill. Sendzimir planetary mills were generally described in a number of United States patents, including U.S. Pat. Nos. 2,932,997; 2,978,933; 3,049,948; 3,076,360; 3,079,975; 3,147,648; 3,138,979; 3,210,981; 3,533,262; and 3,789,646.

The differences between the Platzer planetary mill and the Sendzimir planetary mill were and remain well-known to one of ordinary skill in the art. In practical applications, it was known that a minimum feed slab thickness for a Sendzimir mill of at least about 120 mm was required to produce acceptable rolled product. For a given width, this greatly exceeded the minimum thickness which Platzer planetary mill technology would require. It was also well known that the rolled strip exiting from a Sendzimir planetary mill was not flat, exhibiting a marked scalloping or rippling in the rolling direction which required additional finishing mills to flatten the strip. The inability of a Sendzimir planetary mill to provide flat strip, in comparison to Platzer technology, was a direct result of the difference in construction between these types of planetary mill. Sendzimir planetary mills include a rotating beam, while Platzer planetary mills use a stationary back-up beam. The flow of metal through the Sendzimir mill, because of the rotating beam, is such that the scalloped or rippled strip results. The stationary back-up beam of the Platzer planetary mill establishes a metal flow during rolling that does not distort the strip, such that only a very slight, long wave in the longitudinal casting/rolling direction may result on occasion.

The fixed versus rotating beam difference between Platzer and Sendzimir planetary mill technology presents another advantage to use of Platzer technology. Because of the stationary back-up beam, it is possible, through use of various inserts in the beam, to provide a transverse (across the casting/rolling direction) profile to the slab by the rolling process. By use of such selected inserts, a Platzer planetary mill can provide an optimal profile to the output slab for further downstream processing, without the need for additional millstands dedicated to profiling the output sheet after reduction in the planetary mill.

The Platzer planetary mill is also capable of adjustment to close down the roll gap, allowing for optimization of the initial entry thickness and increased running reduction after threading. In contrast, the initial entry of the steel in a Sendzimir planetary mill cannot be adjusted down; it is established by the mill size itself, and cannot be varied.

With respect to operating costs, and maintenance, the Sendzimir planetary mill was more costly to use, primarily because of the roll gap friction difference over a Platzer planetary mill. Because of the configuration of the Sendzimir planetary mill, there is considerable friction between the work rolls and the slab being rolled. This causes increased wear on the work rolls and increased power consumption and motor sizing requirements, in comparison to a Platzer planetary mill. In a Platzer planetary mill, there is little friction between the work rolls and the slab; the main friction encountered is that in the bearings in the intermediate rolls. The result is that work roll life is longer, and operating and capital costs lower, than that of a Sendzimir planetary mill.

Sendzimir, "Hot Strip Mills for Thin Slab Continuous Casting Systems," *Iron and Steel Engineer*, October 1986, p. 36, described a proposed Sendzimir planetary mill layout, and illustrated several continuous casting/-planetary mill and thin slab caster (Hazelett)/planetary mill combinations (see FIGS. 8–9). The basic planetary hot strip mill layout illustrated by Sendzimir (FIG. 1) comprised an edger and descaler preceding the feed rolls used to feed the slab into the roll gap of the planetary mill. Downstream take-off from the Sendzimir planetary mill was effected by a planishing mill acting through a set of tensioning rolls. A runout table, pinch rolls and carousel coiler completed the disclosed set-up.

(A planishing mill, as that term is understood by one of ordinary skill in the art, would provide less than a 10% reduction to the feed strip. In usual usage, a "planishing" mill would function substantially as a flattening device, which would, as part of that process, take no more than a maximum 3–5% reduction.)

The Sendzimir planetary mill was stated to be capable of a reduction in thickness of 95% in one pass. The feed rolls were stated to "push the slab, taking a small reduction, through a guide into the planetary rolls, where the main reduction is accomplished . . . " (p. 36). One or two sets of two high feed rolls were disclosed (pp. 36–37; FIG. 2). Sendzimir taught that the planetary mill should "be operated continuously, with [discrete] slabs being fed one butting against another and with the continuous, high temperature, high heat input furnace located in tandem with the mill. Slab temperature can be kept constant within precise limits and close gauge control of the finished strip is easily obtained. In fact, commercial cold rolling tolerances can be obtained directly from the hot mill, end to end, without any long, heavy leading or trailing ends. With automatic gage control at the planishing stand, an even finer adjustment will be obtained" (p. 37). In this configuration, Sendzimir was clearly not disclosing a fully continuous process using as-continuously cast endless slab steel directly from a continuous caster, but instead was describing a system for use with discrete slabs.

Sendzimir also disclosed allegedly experimental tandem operation of continuous casting devices combined with planetary mills:

> Experimental tandem operation of casters and planetary mills
>
> More than 20 years ago, attempts were already being made to continuously roll slabs with the objective of converting the entire heat of the furnace into hot coils (FIG. 8). Numerous metallurgical, handling, reheating and surface problems were encountered. Balancing the output of the caster proved difficult together with handling the slab on the runout table, entry into the furnace, and operation of the planetary mill and coiler.
>
> An initial mold size of $2\frac{1}{2}\times17\frac{1}{2}$ in. [50×435 mm] was tried in Germany. It was too small and the speed of casting too slow for successful hot rolling downstream. With a slab speed of 4 to 5 fpm [1.5 m/min], the slab edges were black when entering the rolling mill. However, when everything was working properly, 80-in. OD coils were produced.
>
> Next, a high-tonnage, proven continuous caster coupled with a planetary mill in the U.S. provided slabs which entered the mill at 16 to 18 fpm [5 m/min]. The heat balance was correct and 60-ton hot coils were produced on an experimental basis.
>
> In a third attempt, in Austria, the objective was to put the planetary mill back to back in tandem with the caster, eliminating the heating furnace but considering use of an equalization hood and possibly an edge reheater. This scheme would have required allowing the dummy bar head from the caster to go through the planetary mill and be cut off by a flying shear just ahead of the coiler. Experiments were conducted with a planetary roll bite made directly into the cast section, with the mill screwdown coming on blocks to achieve the desired gage. The experiments were successful; a tapered section after the dummy bar head proved that only a small amount of the metal would have to be scrapped.
>
> New attempts in the future will utilize past experience and, at the same time, permit working with thinner cast sections from newer types of casters. For example, a mill is under consideration for rolling continuously cast sections of 2×50 in. [50×1,250 mm] and $1\frac{1}{2}\times50$ in. [37×1,250 mm], but with both systems able to roll cast sections as thick as 3-in. for special products.

Page 39. FIG. 8, which included a slab cutting station between the continuous caster and the equalizing furnace, began the disclosed feeding sequence to the Sendzimir planetary mill, such that there again was no as-continuously cast endless slab of steel in the continuous casting/planetary mill combination. Plainly, Sendzimir's teachings in regard to those configurations were all directed to discrete, non-continuous slab rolling operations, even where the primary source of those discrete slabs was a continuous casting device.

Sendzimir also disclosed a thick-slab Hazelett caster/planetary mill combination (pp. 40–41, FIG. 9). The Hazelett caster "is used to produce 2-in. [50 mm] thick slabs which pass through a reheat furnace before entering a planetary mill followed by a planishing mill. Strip exits the planetary mill at a nominal thickness of 0.150 in. [3.8 mm] and from the planishing mill at a nominal thickness of 0.135 in. [3.4 mm]. The slab exists the Hazelett caster at 24.5 fpm [7.3 m/min] with the strip exiting the planetary mill at 327 fpm [98 m/min] and the planishing mill at 364 fpm [109 m/min]" (pg. 40).

Sendzimir addressed the particulars of the optional downstream planishing mill, with regard to both number and function:

> Planishing mill—Downstream from the planetary mill, it may be desirable to include one or more planishing mills, depending on factors such as if the product is simple or sophisticated, whether the hot strip will be used directly or will be cold rolled, if metallurgical cleanliness or low cost is dominant in steel production, and whether the steel is a special type as such as low alloy high strength, high alloy, silicon or stainless. In deciding to include planishing mills, the need for heavy reduction after the planetary mill must be balanced against added investment cost and hot strip quality.
>
> A 10% reduction in the planishing mill might be sufficient for many applications, e.g., galvanized steel. Reductions of 35 to 50% might be appropriate for hot strip to be used for building construction where light reflection will accentuate surface detail. Normally, a simple 2-h mill could achieve a 10 to 12% reduction and eliminate most of the scallops. Although 3-h mills give reductions of up to 20%, work roll wear would make this solution questionable for mills operating continuously for 20-hr. periods. This could also apply to mills such as the 4 and 6-h type used at the Nippon Yakin 68-in. wide installation. Although these two types of mill could achieve reductions of 30 to 35% and provide good shape (especially the 6-h), work roll wear and the need for exchanging rolls would limit their application for long continuous runs.
>
> After the planishing mill, there should be a flying shear and a coiler. The coiler can be of the carousel type or two separate coilers can be used to handle the uninterrupted flow of strip.
>
> When the strip is parted by the shear, the trailing end must be accelerated away from the succeeding coil. A gap of 10 to 15 ft [3–4.5 m] is desirable so that the front end can be caught in the coiler without creating a stoppage.

Pages 41–42. The work roll wear problem in the three-high, four-high and six-high mills used in the noted combination was plainly quite serious. Any system which would adopt a casting campaign which would approach 20 to 24 hours in duration, or longer, would plainly exceed the disclosed operable periods in Sendzimir.

Discontinuous rolling with a reversing mill was disclosed by Sendzimir to solve this problem with thin-section casting systems. For such a system to function, Sendzimir indicated, the reversing mill would require elaborate, expensive electrical equipment of substantial speed and power. If continuous operation of the discontinuous rolling mill was sought, two hot coil boxes and their attendant substantial capital outlay would be required. The reversing millstand, in that case, could be a four-high or six-high mill, or a two-high mill, which "would permit heavier reduction in each finishing pass, thinner gages (e.g., 0.040 in.) [1.016 mm], and better gage accuracy."

Proposed Sendzimir planetary mill installations were purported to have used one or two (2) planishing mills, comprising three- and four-high millstands, effecting 14, 20% reduction (one planishing mill), or 26% reduction (first mill), and 23% reduction (second mill), when two (2) three-high millstands were used. Upstream feed roll reductions of 16, 20% (one feed roll) or 22% (first feed roll), 28% (second feed roll) were stated to also have been used, with two (2) feed rolls/two (2) planishing millstands in combination having been one configuration purportedly structured.

None of the prior art teachings concerning Platzer and/or Sendzimir planetary mills disclosed a fully continuous process wherein as-continuously cast endless slab was continuously converted to continuous steel strip, of such gauge/thickness and physical proporties to allow direct use in product manufacture without further processing, particularly cold rolling, without any discrete slab use. In each case, the configurations disclosed did not constitute a fully continuous operations, and did not provide adequate post-planetary mill reductions by hot rolling to achieve necessary thickness and physical properties in the product steel strip.

Despite the teachings of Muenker et al., Fink et al. and Sendzimir, and, in fact, in part because of them, then, the prior art was in actuality still left seeking a fully continuous system and apparatus to make hot rolled steel strip, which would function on the commercial scale under actual manufacturing conditions of strip width and thickness, needed operating efficiency and quality, and available capital and operating (including utilities) cost. None of these disclosures put one of ordinary skill in the steelmaking art into possession of a continuous system, capable of steady state operation at economic production rates, which processed as-continuously cast steel slabs into thin steel strip in one endless process.

Contrary to the implications or statements in the Muenker et al., Fink et al. and Sendzimir papers, discrete slabs could not simply be butted up against each other and force-fed into a planetary mill. Right-angled abutting front end (following slab) to tail end (leading slab) arrangements of successive discrete slabs would not consistently feed into a planetary mill. Slabs could bind and ride up, front end on leading tail end, or be accordioned by the entry. Damage to the mill would result, or loss of slabs. The front and tail edges of slabs would be shaped, such as by machining of cooled slabs, to make an operable process, which slabs would dovetail or mate to mimic an as-continuously cast slab. A chevron configuration was preferred, the tail end of the leading slab bearing a female shape resembling the tail end of an arrow, and the front end of the trailing slab bearing a male shape resembling an arrow head. This added substantial cost to the process, and increased processing time to a commercially unacceptable level.

Use of a series of discrete slabs in the prior art discontinuous sytems caused additional problems downstream of the rolling mills. Runout roller tables comprise roller and apron means over which the hot strip must be transported towards the down-coiler and its associated pinch roller. When the front end of the discrete strip begins its travel over the table, the strip thickness, strip speed and the friction encountered by the strip tends to intermittently bind and release it, causing buckling, deflection, distortion, and, in the worst case, causing the strip to fly away from the table. This causes damage to the strip or, in the case of table cobble, complete loss. Thus, transporting each strip down the table into the pinch roll and down-coiler risks these problems. With the discrete slab processes, this transporting and feeding through pinch rollers must be repeated with every new discrete strip, resulting in repeated risk of lost, defective strip and unacceptable process downtime.

Combinations of continuous casting devices with planetary mills, hot rolling mills and cold rolling mills were known. Hartog et al., EP 0 306 076, Method and Apparatus For The Manufacture of Formable Steel Strip, assigned to Hoogovens Group B.V. (published Mar. 8, 1989), disclosed several such combinations, to produce a formable steel strip with a thickness of between 0.5 and 1.5 mm (page 2, col. 1 11. 1-3). Hartog et al. was directed to a very specialized application, requiring the production of a very high quality ferritic steel, whose use for deep drawing applications was dependent on those special metallurgical properties.

Hartog et al. described the conventional method of production of steel strip, which their invention allegedly sought to improve upon:

> [I]n the production of thin steel strip, conventionally the starting material is thick steel slab, having a thickness of between 150 and 300 mm, which after being heated and homogenized at a temperature between 1,000° C. and 1,250° C. is roughened down to form an intermediate slab with a thickness of approximately 35 mm, which is then reduced to a thickness of between 2.5 and 4 mm in a hot strip finishing train consisting of several millstands. Further reduction to strip with a thickness of between 0.75 and 2 mm then takes place in a cold rolling installation. The previously pickled strip is cold reduced in a number of interlinked millstands, with addition of a cooling lubricant. Methods have also been suggested in which thin slabs are cast, and after being heated and homogenized, are passed direct to a hot strip finishing train. All such known and proposed rolling processes have been developed for discontinuous rolling operations. The casting of the slabs, the hot rolling of the slabs and the cold rolling of strip take place in different installations, which are effectively used only during a part of the available machine time. In a discontinuous rolling operation, it is necessary for the running of the installations to take into account the entry and exit of each slab and the temperature differences which can occur between the head and tail of each slab. This can lead to complicated and expensive measures.

Page 2, col. 1, 11. 10-38.

The supposed key to the Hartog et al. invention was the alleged discovery that

> good results can be obtained when, after hot rolling of continuously cast steel slab in the austenitic region to form sheet, a further rolling of the thin sheet (2-5 mm) can take place at lower speeds (i.e., less than 1,000 m/min. preferably less than 750 m/min.), provided that this rolling is in the ferritic region, i.e., below temperature $T_1$ (see below). This rolling is preferably followed by overaging at 300-450° C. The result is a formable thin sheet strip which has good mechanical and surface properties and does not require cold-rolling.

Page 2, col. 2, 11 35-46.

To produce the thin steel strip, Hartog et al. disclosed the sequential performance, in a continuous process, of the steps of:

> (a) in a continuous casting machine, forming liquid steel into a hot slab having a thickness of less than 100 mm.
> (b) hot rolling the hot slab from step (a), in the austenitic region and below 1,100° C., to form strip having a thickness of between 2 and 5 mm.
> (c) cooling the strip from step (b) to a temperature between 300° C. and the temperature $T_1$ at which 75% of the steel is converted to ferrite.
> (d) rolling the cooled strip from step (c) at said temperature between 300° C. and $T_1$ with a thickness reduction of at least 25%, preferably at least 30%, at a rolling speed not more than 1,000 m/min., and
> (e) coiling the rolled strip from step (d). The temperature $T_1$ in ° C. at which on cooling 75% of the austenite is converted into ferrite has a known relationship with the percentage of carbon in the steel, namely $T_1 = 910-890(\%C)$.

Page 3, col. 3, 11. 5-23.

Hartog et.al. emphasized that their process allowed the casting of thin slabs, on the order of approximately 50 mm, instead of the known 150-300 mm slabs, with resulting savings in continuous casting device construction. The separation of the rolling in the austenitic region (step b) from rolling in the ferritic region (step d) by the step c cooling step, thereby avoiding so-called two-phase rolling, was critical to achieving good mechanical and surface properties independently of the speed of deformation, allowing lower speed operation than that disclosed as necessary by certain other art (page 2, col. 3, 11. 24-52). Up to 120 tons of steel, Hartog et al. disclosed, could purportedly be continuously cast into 0.5-1.5 mm sheet by their process, with virtual 100% use of continuous casting device material output, an allegedly superior result over prior art discontinuous processes starting from steel slabs having a maximum weight of 25 tons (page 2, col. 3, 1. 53-col. 4, 1. 10).

The ferritic cold rolling (400-600° C.) portion of the Hartog et al. process required at least a 25% thickness reduction (page 2, col. 4, 11. 46-48). The austenitic hot rolling step preferably effected a considerable reduction in thickness in a few stages, including the planetary mill. Hartog et al. taught a "main reduction" in a planetary mill, after which a rolling reduction of not more than 40%, e.g., 10% to 20%, was applied in a "planishing" millstand, "in order to correct the shape of the strip and improve the crystal structure" (page 4, col. 5, 11. 34-43). The relationship between the planetary mill, the "planishing" mill, product flatness and grain size was set out:

> The main reduction by the planetary millstand can lead to a very fine grain size which is undesirable for deep-drawing qualities. The second-stage small reduction of not more than 40% at the prevailing rolling temperature can then lead to a critical grain growth which converts the fine grains into more desirable coarse grains. A planetary millstand can give rise to the formation of a light wavy pattern in the sheet. By the further reduction in the planishing millstand it has appeared possible to remove this wave shape entirely. Optimum rolling conditions can be achieved in the planetary millstand if before hot rolling the slab is first passed through a homogenizing furnace and held at a temperature of 850-1,000° C. preferably about 950° C.

page 11, col. 5, 11. 43–58.

FIGS. 1–3 disclosed several configurations of the Hartog et al. apparatus, each of which include a continuous caster followed by a homogenizing furnace, followed by a planetary mill, followed by a "planishing" millstand for hot rolling, followed by cooling means, and then followed by one or two (2) cold rolling, four-high millstands.

As for casting speed and reductions, Hartog et al. suggested that a continuous slab of about 50 mm thickness and width of about 1,250 mm be cast at a speed of about 5 m/min. with the planetary mill reducing same in one pass to a thickness of between 2 and 5 mm. The resulting very fine grained austenitic material, when next passed through the single hot "planishing" mill, underwent a maximum 40% further hot reduction. More particularly, Hartog et al. thought that, where a final steel strip thickness of between 0.6 and 1.5 mm was desired, the thickness before and after the cold mill (one or two (2) four-high millstands), needed to be adjusted to achieve a reduction of at least 25%, though "a reduction of more than 40%, e.g. 60%, should be sought" (page 5, col. 7, 11. 10–30; col. 7, 1. 57–col. 8, 1. 9). Use of two (2) four-high cold millstands was suggested where a certain ferritic reduction was desired for product quality, mostly where a high quality, deep drawing steel grade was desired, and a recrystallization annealing step, with necessary longer annealing time (10–90 seconds) furnace residence would necessarily follow the cold rolling (page 6, col. 9, 11. 13–27).

Hartog et al. plainly added nothing to the disclosures cf processing configurations incorporating Platzer and Sendzimir planetary mills, except the mandated use of a cold rolling operation as a critical part of the sequence.

The prior art thus failed to disclose a configuration or process which would result in the production of directly-usable, properly gauged, metallurgically acceptable strip steel, by a fully continuous process which did not use discrete slabs of cast steel, and failed to disclose a fully continuous process which could provide steel strip of thickness of less than 1.8 mm, without the need for cold rolling, from as-continuously cast endless steel slab.

The steelmaking art therefore had to cold roll and otherwise further process hot rolled strip steel before end product manufacturing thicknesses of less than 1.8 mm could be achieved, and the desired physical properties obtained. Capital outlay and operating expenditures remained substantial because of this need for cold rolling, as well as the failure to engage in fully continuous processing of the as-continuously cast endless steel slab.

SUMMARY OF THE INVENTION

The present invention utilizes a Platzer planetary mill in conjunction with hot rolling millstands and related equipment to continuously process an as-continuously cast endless steel slab to steel strip having thicknesses and physical properties presently not achieved or achievable without cold rolling. The invention provides apparatus, process and products which substantially replace the known cold rolled strip steel gauges with hot rolled steel strip of identical gauge and equivalent or superior physical properties, attained at lower capital cost and with lower use of utilities, principally electricity for providing of heat and driving force for the various rolling mills. The resulting thin steel strip .has physical properties at least as advantageous as those produced by the mandated use of the cold rolling techniques of the prior art.

The invention obviates the prior .art shortcomings by providing apparatus, process and products which, in one fully continuous operation, continuously casts and hot rolls with high reduction, without division into discrete slabs and without need or use of any subsequent cold rolling, an endless slab of steel or other. ferrous metal, into thin strip, said product strip having the physical properties and gauge that otherwise requires cold rolling in known processes.

The invention thus replaces thin steel strip previously available only as a cold rolled product, with thin hot rolled steel strip of identical gauge and substantially identical physical properties.

The apparatus and process of the invention also avoid the difficulties caused by processes comprising use of discrete slabs produced from continuous casting followed by hot rolling and then cold rolling, in regard to rolling mill threading and start up, and in speed, speed matching and millstand power requirements. Because the apparatus and process of the invention provides for fully continuous operation, with no use of discrete slabs cut from the as-continuously cast endless steel slab, the introduction of the steel into the millstand train need only be done once in each casting campaign, the millstands need not have the over-capacity of electric motor power to effect "zooming" acceleration that the prior art apparatus and processes required, coil boxes need not be included in the system, and capital costs and operating costs are minimized. The Platzer planetary mill of this invention has an entry speed of approximately about 2.5 to 3.5 meters per minute. This entry speed coincides with the outlet speed from the thin slab continuous casting device of the invention. Thus, it is not necessary to cut up the as-continuously cast endless steel slab into a plurality of discrete slabs to facilitate speed-matching of process components, particularly to millstand speed.

In the invention, the fully continuous process and apparatus removes and avoids the prior art problems relating to the run-out table noted before. As the front end of the continuous strip is transported over the run-out table only once in each casting campaign, and then threaded through the pinch roll associated with the down-coiler, there is substantially no risk of strip damage or loss, or dangerous strip fly away, once that initial operation is completed. This is because all cutting of the strip in the process of the invention takes place at the pinch roll, such as when coils are made to desired size and a new coil is started. Moreover, the continuous rolling of endless slab into the thin hot rolled steel strip of the invention offers another advantage over the prior art discrete slab processes in terms of coil weight relative to width. The relevant parameter known to one skilled in the art as "PIW" (or kg/mm width) relates strip width, length and weight. The most modern known hot strip mills, using the discrete slab processes, are capable of producing coil having a maximum PIW of about 1,000 at a thickness of greater than 1.8 mm. The fully continuous process of the invention, rolling an endless slab, in particular combination with shear means located just ahead of the down-coiler, allows the production of a PIW of substantially any size and weight, thus allowing service of much broader markets and end use applications.

The apparatus, process and products of the invention provide continuous steel strip of a thickness less than about 1.8 mm in standard commercial strip widths. The prior art devices and apparatus were not capable of providing strip of widths of 600 mm or greater. The invention, to the contrary, is capable of providing strip of at least 600 mm, including strip of 1,524 mm width. Preferably, the apparatus, process and products of the invention provide strip of at least about 600 mm in width, most preferably in widths from about 1,000 mm to 1,600 mm.

The as-continuously cast endless thin steel slab of the invention, having a thickness no greater than 50–100 mm, more preferably about 50–90 mm, and optimally about 70 to about 90 mm exiting from the continuous caster, is fed directly into the Platzer planetary mill, having first been provided with. controlled induction preheat if necessary, which sequence conserves the heat energy in the slab from the caster better than a series of discrete slabs will possess, as was the prior art practice. The reduced slab exits the Platzer planetary mill with a thickness of about 3–15 mm. It then enters a series of hot rolling millstands with said 3–15 mm thickness and exits at less than 1.8 mm thickness. There may be applications where even thinner steel strip would be required, having a thickness of 1 mm or less, such as 0.7–0.8 mm, which may be produced by the invention. The steel strip obtained by the invention has physical properties at least equivalent to those produced by cold rolling to required thickness, as done through the prior art techniques, without any cold rolling being carried out.

The exit speed from the Platzer planetary mill of the invention is substantially lower than known prior art roughing millstands, being approximately one-quarter of that exit speed. This avoids the prior art problems related to threading the millstands with thin hot strip, handling the hot strip at very high speeds and eliminating extra electrical energy required to accelerate the mill train in order to compensate for the differential temperature of the head and the tail end of the slab.

The present invention thus relates to a fully continuous process for making flat hot rolled steel ferrous metal strip having a thickness presently attainable only after cold rolling and associated processing, comprising the steps of continuously feeding an as-continuously cast endless thin slab of steel or ferrous metal into a Platzer planetary mill to effect a first reduction in thickness from the as-continuously cast thickness of the slab to produce a continuous hot strip having a first reduced thickness, sequentially receiving that continuous hot strip from the Platzer planetary mill by a plurality of hot rolling millstands to effect additional reductions in thickness to at least about 50% of said first reduced thickness such that the hot strip has an average thickness of less than about 1.8 mm, preferably about mm or less, optimally 0.7–0.8 mm, and reheating the continuous hot strip between adjacent millstands by reheating means to maintain the continuous steel strip temperatures sufficient to effect said additional reductions in thickness. (The endless steel strip would cool very rapidly in the process, if reheaters were not placed between the millstands in the system to maintain the steel strip at a working temperature sufficient to achieve the required reduction in thickness while additionally providing the required and desired metallurgy.)

The invention also relates to a system and apparatus for continuously making flat rolled steel or ferrous metal strip having a minimum thickness sufficient to allow substantially direct article-of-manufacture fabrication therefrom, comprising a continuous casting device, a Platzer planetary mill for continuously receiving an as-continuously cast endless slab of steel or ferrous metal from said casting device and effecting a first reduction in thickness from the as-cast thickness of the slab to produce a continuous hot strip having a first reduced thickness, a plurality of hot rolling millstands sequentially receiving the continuous hot strip from the Platzer planetary mill to effect additional reductions in thickness to at least about 50% of said first reduced thickness such that the hot strip has an average thickness of less than about 1.8 mm, preferably about 1 mm or less, optimally 0.7–0.8 mm, and reheaters placed between the adjacent millstands to maintain the continuous steel strip temperatures sufficient to effect said second reduction in thickness.

In the preferred embodiments of the present invention, a continuous casting process is used to continuously form a hot slab of steel, having a thickness of approximately 70–90 mm. The hot, as-continuously cast endless slab of steel is fed into a Platzer planetary mill for a first reduction in thickness. The output of the Platzer mill is a continuous steel strip reduced to a first thickness of approximately 3 to 15 mm. The reduced thickness strip of steel is sequentially received by a plurality of hot rolling millstands that effect a total second reduction in thickness to about 1 mm or less. Electric induction reheaters are placed between the adjacent hot rolling millstands to maintain the steel strip at desired working temperatures. The endless continuous cast slab is continuously fed into the Platzer planetary mill at the rate of about 2.5 to 3.5 meters per minute from the continuous caster. When the 3–15 mm thickness steel strip from the output of the Platzer planetary mill passes continuously through the hot rolling millstands, the slab thickness is reduced to said finished thickness. The steel strip may then be coiled ready for shipment or may be further processed as desired.

Thus, it is a general object of the present invention to provide a system and process for continuously manufacturing hot rolled steel strips that originate with a continuous casting process having an initial thickness of slab steel and continuously reducing the steel in the endless process to a desired thickness of steel strip, from which articles of manufacture, such as appliances and other products made from strip steel, may be directly produced without cold rolling.

It is a specific object of the present invention to provide a system and process for producing steel in which a Platzer planetary mill is combined with at least three (3) hot rolling millstands to continuously reduce the thickness of the as-continuously cast endless steel slab to a thickness of 1 mm or less without cold rolling.

It is still another specific object of the present invention to provide reheaters between each of the at least three (3) hot rolling millstands to maintain the temperature of the steel strip at desired working temperatures.

It is also an object of this invention to continuously cast and hot roll continuous strip without the use of discrete slabs and without having to accelerate the mill train due to the temperature difference between head and tail end of such discrete slabs. By matching the speed of the thin slab continuous caster, the Platzer planetary mill, and the associated hot rolling millstands, and providing reheaters between adjacent millstands, the strip will be rolled endlessly in a steady state process which will allow greater control of width, thickness, flatness, crown and other dimensional controls, as compared with the present state of the art.

BRIEF DESCRIPTION OF THE DRAWINGS

These and other advantages and objects of the present invention will be more fully understood in conjunction with the accompanying drawings in which like numerals represent like elements and in which:

FIGS. 4A–I are a first diagrammatic representation of a system and process for the present invention (FIGS. 4A, 4D and 4G, in sequence), including charts of expected temperatures of the strip at each stage of the process (FIGS. 4B, 4E and 4H, in sequence, at 3.5 m/min.; FIGS. 4C, 4F and 4I, in sequence, at 2.7 m/min).

FIG. 11E, at 2.7 m/min).

DETAILED DESCRIPTION OF THE INVENTION AND PREFERRED EMBODIMENTS, COMPARATIVE DESCRIPTION OF THE PRIOR ART

Figure 1:
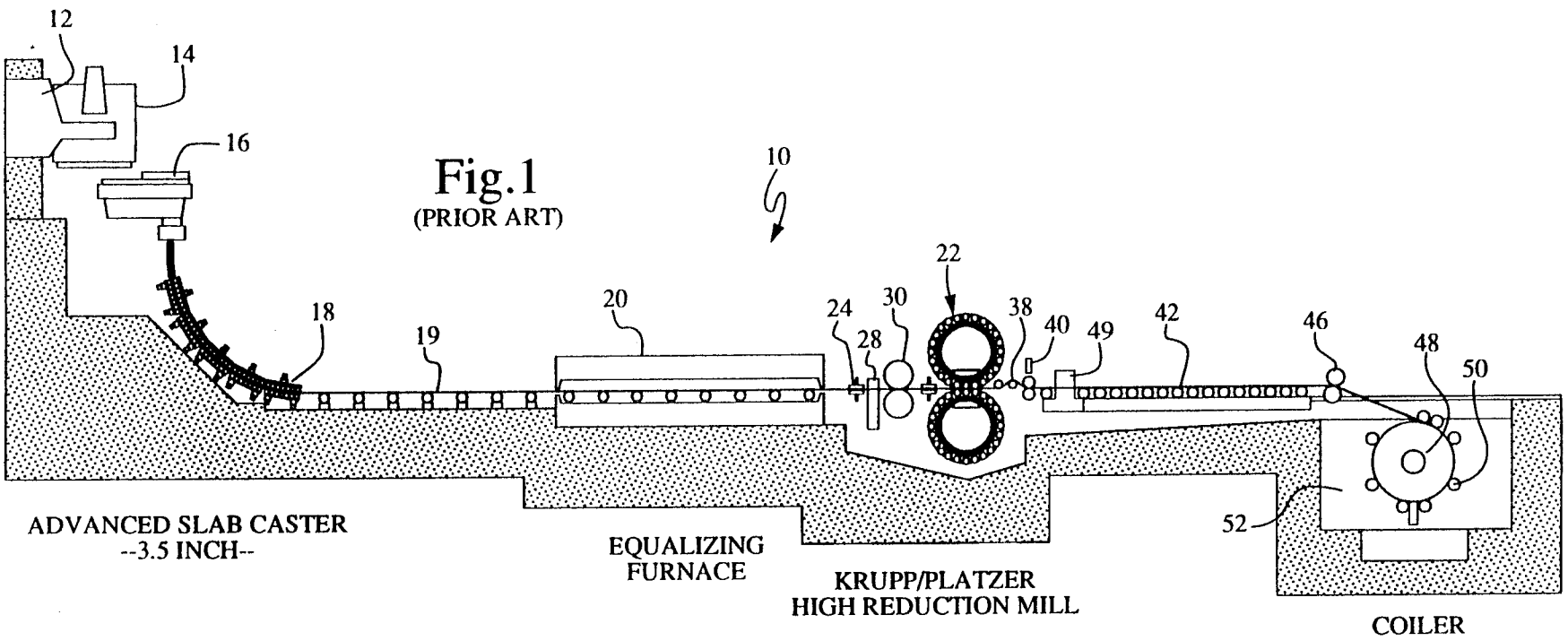
Fig.1 (PRIOR ART)
FIG. 1 is a diagrammatic representation of a prior art system and process for making flat rolled metal sheet.
Figure 2B:
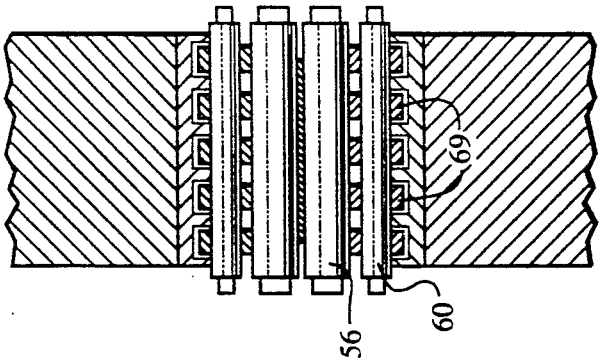
FIG. 2B is an enlarged cross-sectional view, taken at Section lines 2B—2B, shown in FIG. 2A, of the prior art Platzer planetary mill.
Figure 2A:
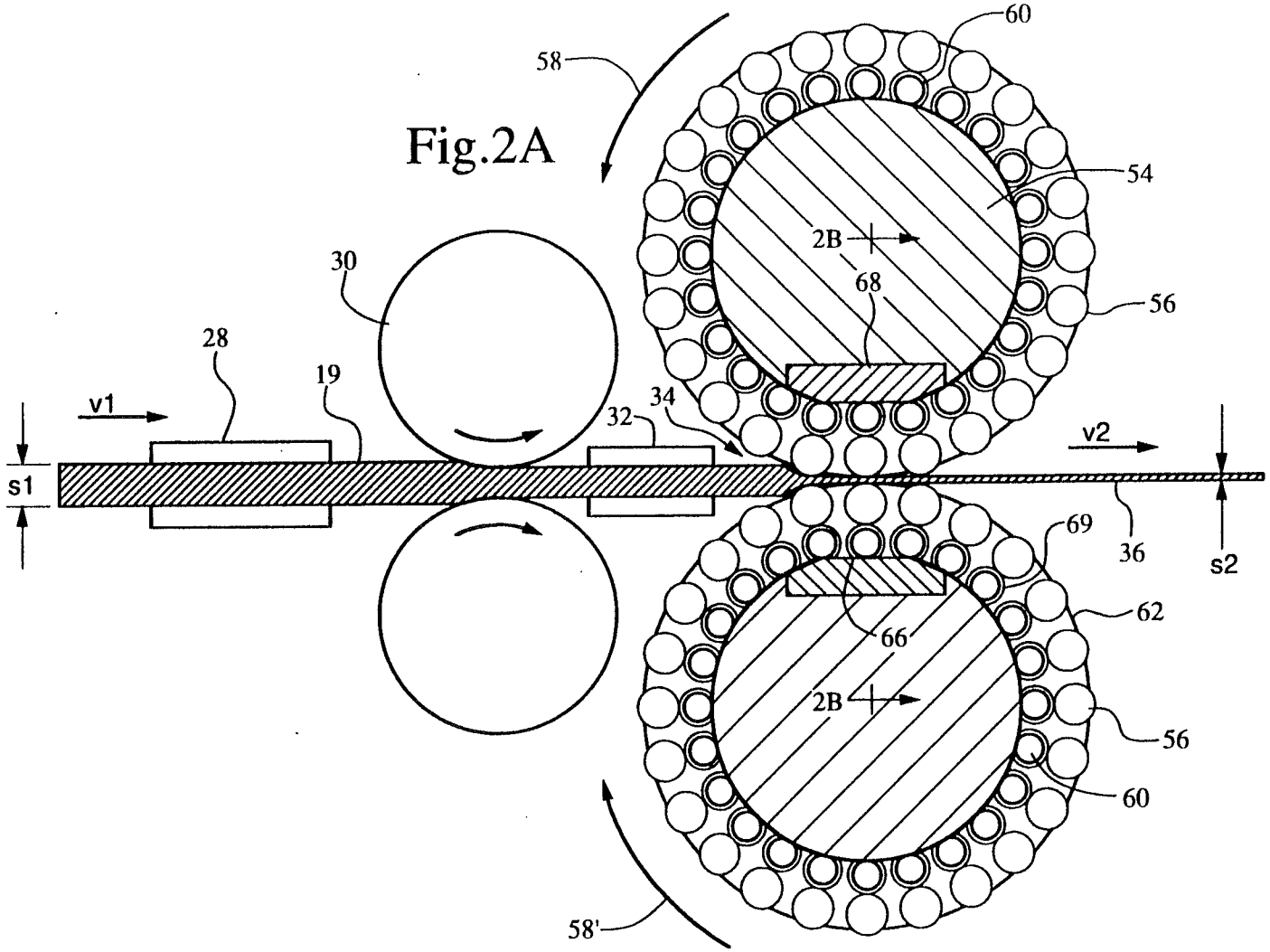
FIG. 2A is a diagrammatic representation of a prior art Platzer planetary mill.
Figure 2C:
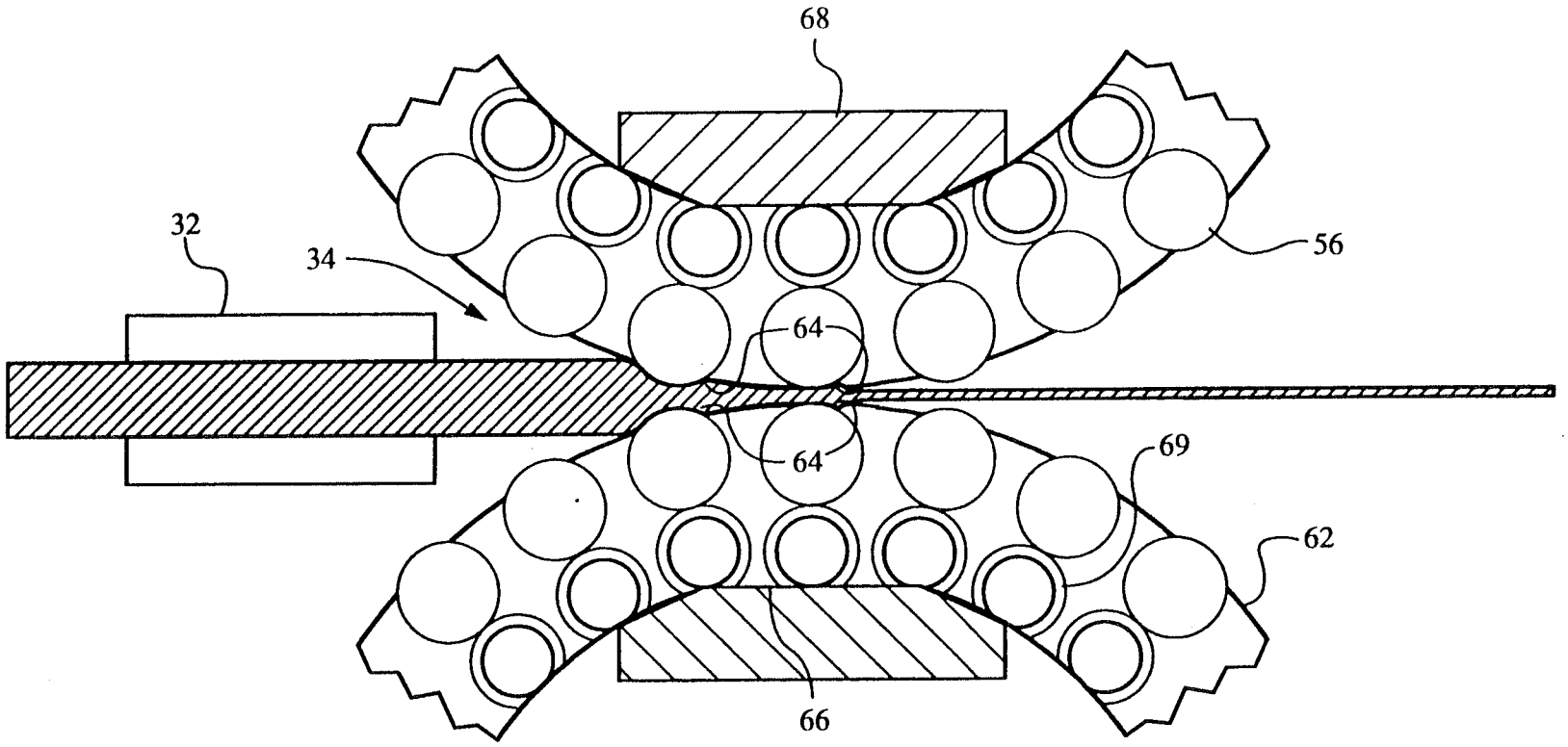
FIG. 2C is an enlarged diagrammatic representation of the nip area of the diagrammatic representation of the prior art Platzer planetary mill shown in FIG. 2A.

FIG. 1 is a diagram of a prior art system for continuous reduction of a continuously cast slab, substantially as disclosed in the aforenoted Fink et al. literature. As can be seen in FIG. 1, the system 10 includes a thin steel slab 19 formed in a continuous thin slab casting device. The casting device comprises a turret 12, ladle 14, tundish and thin slab mold 16, and straightening rolls 18. The thin slab 19 is coupled to a tunnel-type holding or equalizing furnace 20, where the slab is preheated. The heated slab is fed into the rolling gap of a Platzer planetary mill 22 at a constant low speed equal to the casting speed. It passes through edging rollers 24, primary descaler 28, feed roller pair 30 and centering rollers 32 (shown in FIG. 2). A secondary descaler 34 is also shown in FIG. 2. The planetary mill 22 reduces the heated slab 19 a first amount as will be described in detail in relation to FIGS. 2A–C. The high-reduction rolled strip passes through tension rollers 38 into a pinch roll stand 40. No substantial further reduction in thickness is effected in pinch roll stand 40. The finished strip runs onto the discharge roller table 42.

If required, the strip is cut to length by the flying shear 44 and then fed through a pinch roller set 46 to the down-coiler 48 where it is wound into tight coils by the wrapping rollers 50. A coil car 52 places the finished coils onto a chain conveyor belt. Once cooling is completed, this conveyor belt transports the coils into a neighboring area for further processing.

The details of the well-known Platzer planetary mill 22 are disclosed in FIGS. 2A–C. The mill 22 comprises two stationary back-up beams 54 around which two rings of work rolls 56 rotate in a direction indicated by arrows 58 and 58'. The work rolls 56 rotate with intermediate support rolls 60. The work rolls 56 and support rolls 60 can be moved radially in the driven cages 62, run synchronously in counterrotation to one another and rotate in planetary motion around the stationary back-up beams 54. It is from this motion that the name "planetary mill" is derived. Feed rollers 30 slowly force-feed the preheated slabs 19 into the roll gap in the planetary millstand formed by the abutting work rollers 56. At this point each of the pairs of work rolls 56 which rotate at a high speed, rolls a thin layer of material from both sides of the slab into a finished strip. Due to the high degree of overall reduction, as much as 98%, this strip is discharged from the millstand at an increased speed.

A particularly important aspect of rolling is that the small bulb of material 64 which builds up in front of the work rollers 56 is rolled into a completely flat strip (FIG. 2C). For this purpose, the two opposing facing sides 66 of the interchangeable wear parts 68 inserted into the circumference of each of the stationary back-up beams 54 in the roll gap are flattened. The intermediate rollers 60 comprise the intermediate roller shafts and the rings 69 mounted so as to rotate independently which means that the work rollers 56 can also rotate freely. This is a precautionary measure to ensure that constraining forces, friction and wear are kept to a minimum. In order to achieve perfect strip edges, the slab edges may be rounded by profiled adjustable vertical edging rolls 28 and 32.

Figure 3A:
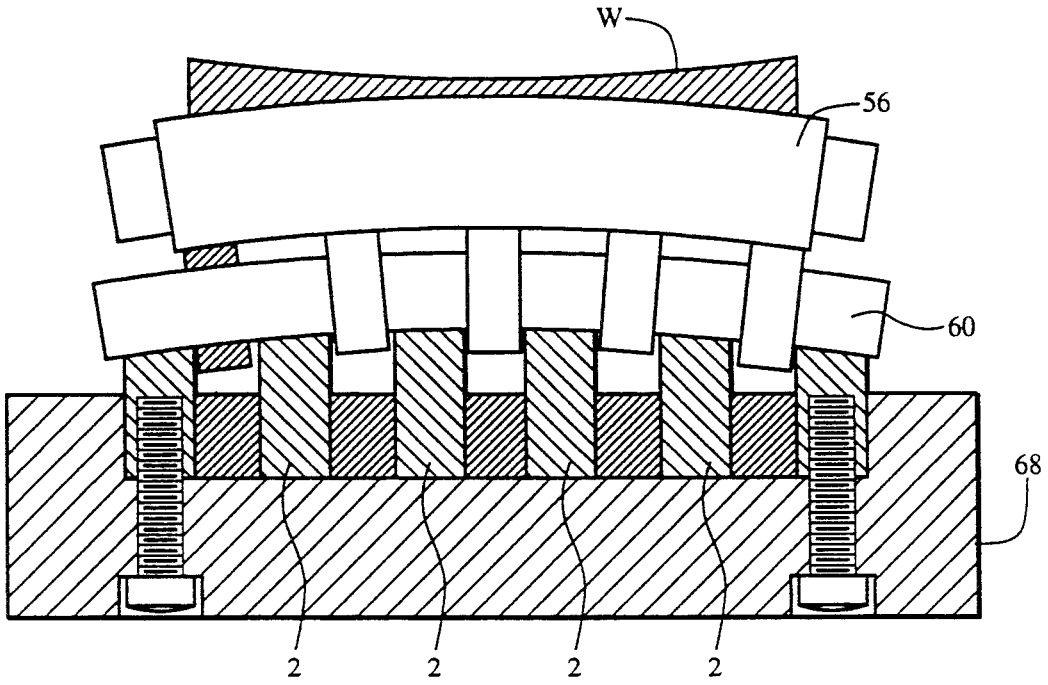
FIG. 3A is a partial section end view of a portion of one embodiment of a Platzer planetary mill of the invention.
Figure 3B:
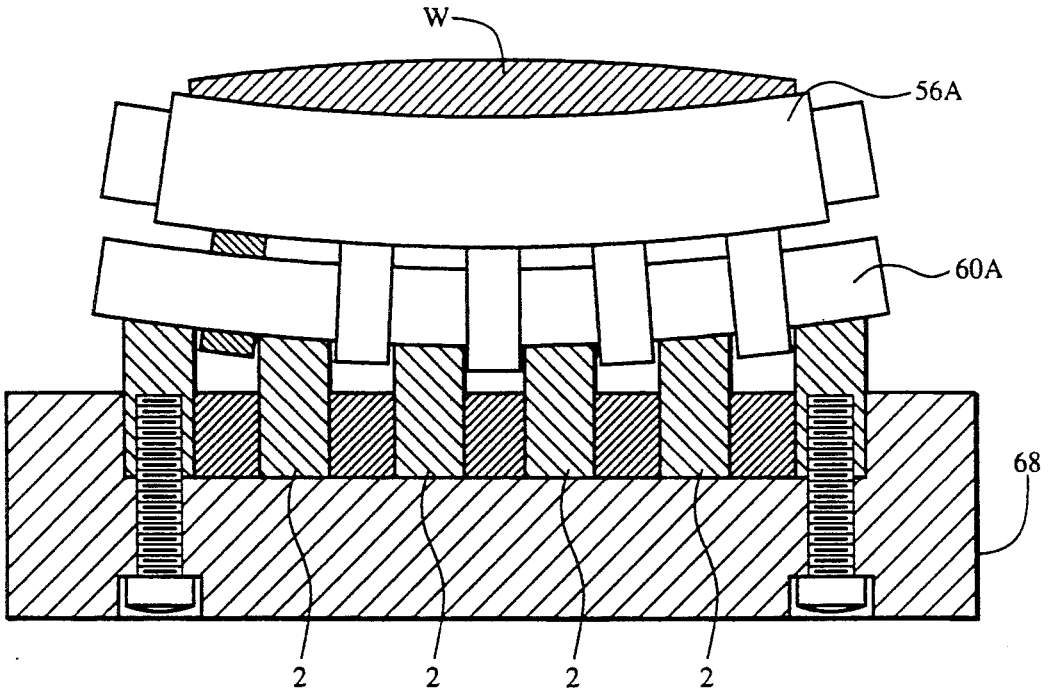
FIG. 3B is a partial section end view of a portion of another embodiment of a Platzer planetary mill of the invention.

FIGS. 3A–B illustrates the use of profiling means in a Platzer planetary mill, in accordance with a preferred embodiment of the invention, whereby profile and shape control is applied to said continuous hot strip. This embodiment is described in part in West-German Patent Application No. 4019562.7, filed Jun. 15, 1990. Two different, basic transverse profiles are shown, a profile presenting two outwardly concave surfaces, shown in FIG. 3A., and a profile presenting two outwardly convex surfaces, shown in FIG. 3B. The outwardly concave surfaces of sheet W in FIG. 3A. are provided by use of orbiting work rolls 56 and support rolls 60, supported by the stationary back-up beam means 54, which include inserts 68 with shaping means 2, which rolls are substantially outwardly (in the direction of the slab being rolled) convex. The outwardly convex surfaces of sheet W in FIG. 3B. are provided by use of orbiting work rolls 56A. and support rolls 60A., supported by the stationary back-up beam means 54, which again include inserts 68 with shaping means 2, which rolls are substantially outwardly (in the direction of the slab being rolled) concave. Other profiles may be provided by variation of the combination of the orbiting work rolls 56 and the shape or configuration of portions of stationary back-up beam means 54, with either transversely uniform or non-uniform cross-sections resulting, dependent upon choice of the skilled worker in the art.

In a further particularly preferred embodiment, the Platzer planetary mill of the invention has a plurality of stationary back-up beam insert means 68, inserted into the circumference of each of the stationary back-up beams 54, which beams are rotatably indexable so as to bring opposing pairs of said means into opposition (see FIGS. 2A–C). The plurality of means 68 will optimally be inserted at equal angular displacement about the circumference, e.g. every 90° if four (4) means 68 are inserted, every 60° if six (6) means 68 are inserted.

As indicated previously, although the thickness S1 of the input slab 19 to the Platzer planetary mill 22 is greatly reduced to that of S2 emerging from the mill as shown in FIG. 2A, the dimension S2 is not sufficiently thin to enable it to go directly to use in the construction of products such as autos, appliances and the like. In this case, the steel must be annealed, pickled and cold rolled to the final thickness.

The novel system of the present invention for providing a continuous process for making thin flat hot rolled steel or ferrous metal sheets having a minimum thickness sufficient to allow substantially direct product manufacture therefrom is shown in FIGS. 4A–4I.

The continuous slab casting device includes turret 12, ladle 14, tundish and thin slab mold 16 and straightening rolls 18, and may comprise a near net shape device. The thin metal slab from the casting plant is most preferably approximately 80 mm in thickness. It passes through edge mill stand 1000 and torch cutter means 1100 into the tunnel-type holding furnace 20 and is preheated to and maintained at a temperature of approximately 1,200–1,250° C. This furnace also serves to homogenize or equalize the slab temperatures, both through the thickness and transversely to the casting/rolling direction. The continuous slab then passes through the Platzer planetary mill 22 and, in a preferred embodiment, emerges as continuous strip with a thickness of approximately 4–6 mm. It then passes in sequence through a first reducing four-high millstand 70 of a type well known in the art, and emerges with a first reduced thickness. It is then reheated in an induction reheater 78 and passed through a second reducing four-high millstand 72 where it is again reduced in thickness. It again passes through a second induction reheater 80 where it is reheated and then passes through a third reducing millstand 74. Finally, it is reheated a third time in induction reheater 82 and is then fed to a fourth four-high millstand 76 where it is reduced to a thickness that can go directly to product manufacture. The amount of reheating is dependent upon the thickness of the slab exiting from the Platzer planetary mill. Any of the known reheating means, including electric induction and gas-fired units, may be used.

The steel strip then passes through rollers 84 and flying shear 3000 to a down-coiling station 86 that has drums 88 and 90 around which the steel is selectively wound. The flying shear cuts the strip at the desired length while it is still moving, such that one coiler can be accepting the steel for coiling while the other is being readied. When the first roller is full and the strip is cut at the desired length, the continuously moving steel strip is fed to the other coiler and wound on that drum.

Figure 4A:
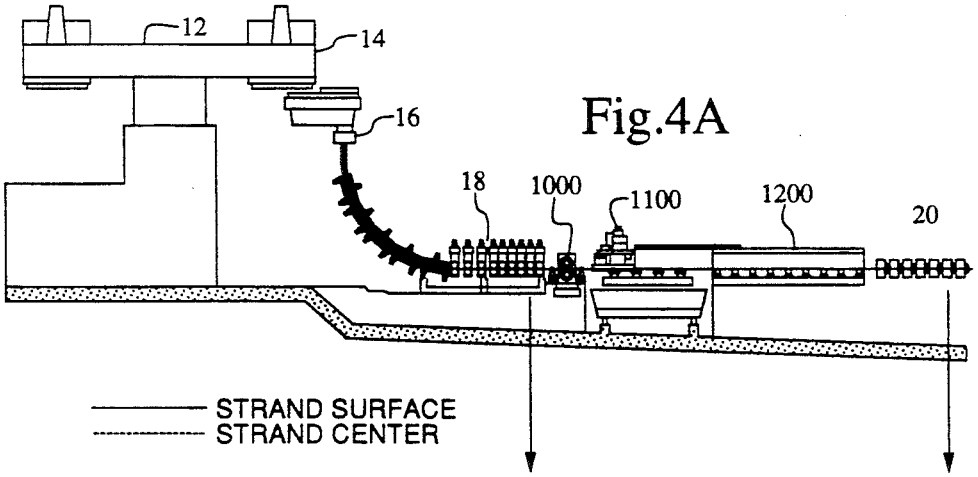
Figure 4B:
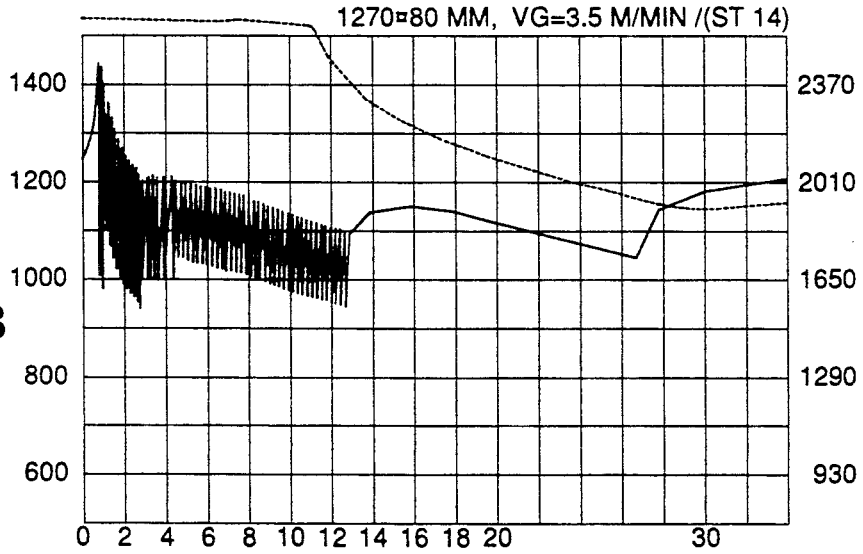
Figure 4C:
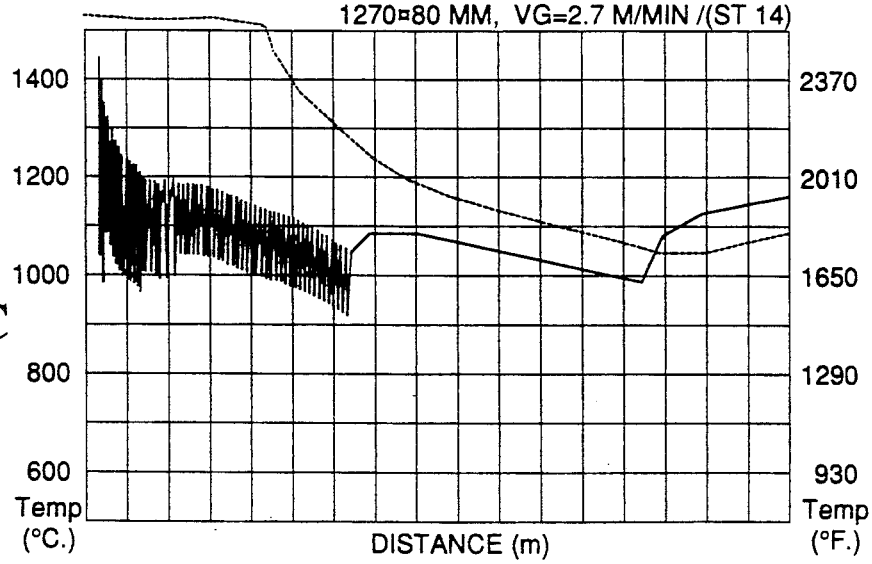
Figure 4D:
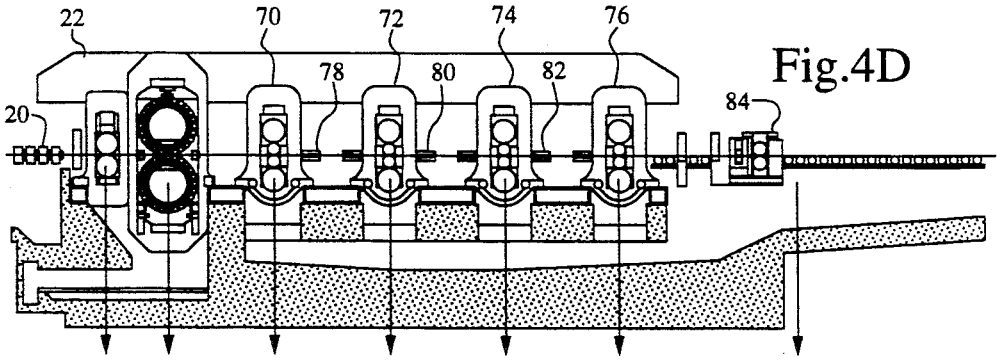
Figure 4E:
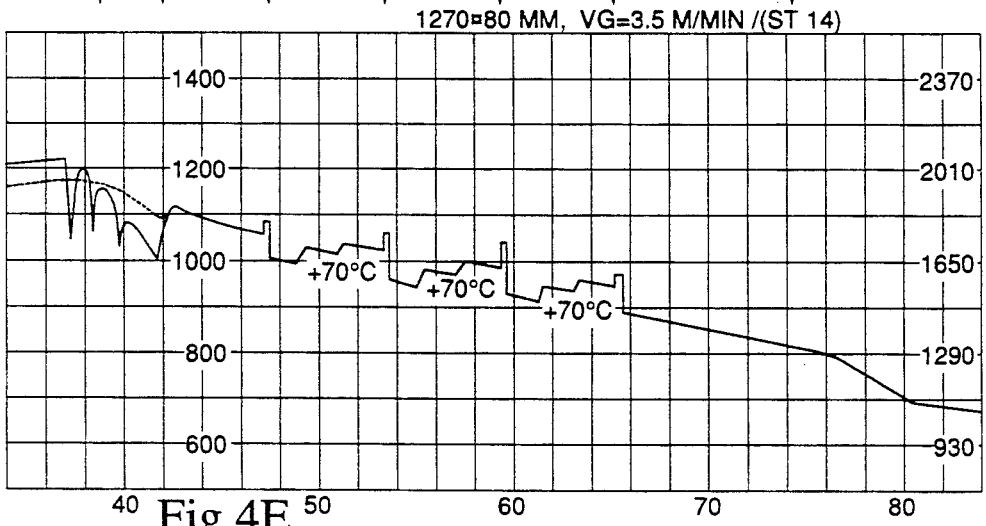
Figure 4F:
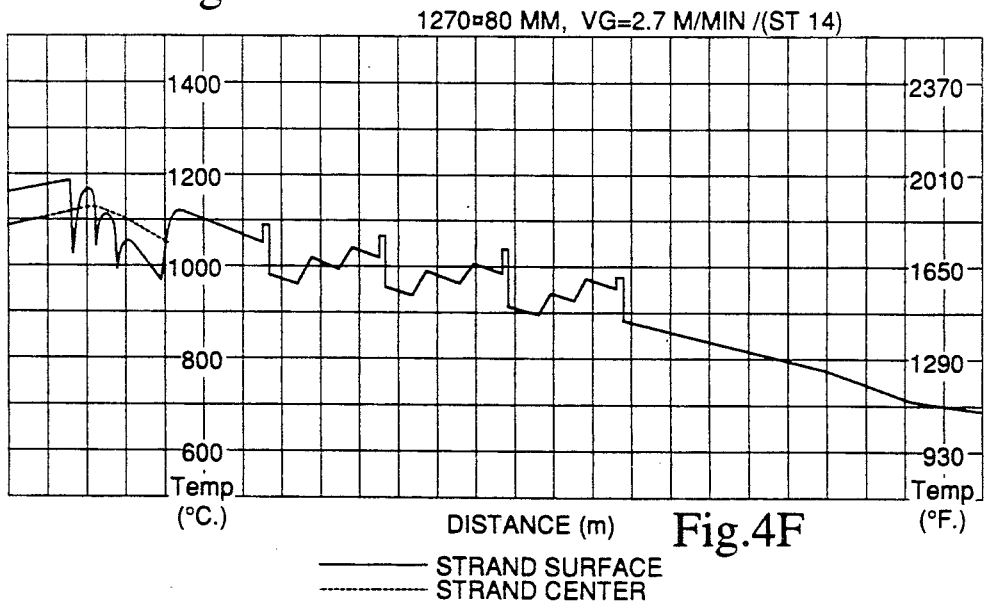

FIG. 4A also illustrates the use of the edge mill 1000 of FIGS. 5A–D, as well as torch means 1100 and drop table means 1200 which allow cutting off of the dummy bar and leading portion of the slab when the casting campaign has just commenced, and removal of the scrap slab from the line with minimal disruption of the operation. Each interstand induction reheater 78, 80 and 82 is positioned transversely offline during the threading procedure illustrated in FIG. 10. Once that procedure is completed, the reheaters are brought in line and into the closed, running positions illustrated in FIG. 4D. Downstream pinch roll and flying shear means 3000, as noted, provide flexible cutting of the strip steel in accordance with operator convenience and efficiency, particularly aiding in efficient down-coiler operation and minimizing of waste from the leading edge of the strip during the threading process, illustrated in FIGS. 10A–F. The two charts in FIGS. [A–C] 4B, 4E and 4H, in sequence, on the one hand, and in FIGS. 4C, 4F and 4I, in sequence, on the other hand, shown below the system of the invention plot calculated temperatures for the slab at two different casting/running speeds, 3.5 m/min. for the upper chart, 2.7 m/min. for the lower chart, for ultimate product strip having a thickness of 0.8.

It is to be understood that the Platzer planetary mill 22 can produce different thickness outputs. The maximum Platzer mill output is about 20 mm, with a 6–12 mm output being attainable with an input thickness of about 80 mm. The thickness of the final strip may vary with the thickness of the output of the mill 22. For instance, if the output thickness of the Platzer planetary mill 22 is 4 mm, the output thickness from the fourth millstand 76 is about 0.8 mm. If the output from the Platzer planetary mill 22 is 6 mm, the output from the fourth millstand 76 will have a thickness of about 1.6 mm. Likewise, if the Platzer planetary mill 22 has an output thickness of 16 mm, the output of the fourth millstand 76 has a thickness of about 1.2 mm. Thus, each of the millstands 72, 74 and 76, as well as the Platzer planetary mill 22, may be adjusted to vary the output thickness thus allowing the final thickness to be that which is desired.

For example, in a preferred embodiment of the invention, the thickness of the endless slab on exit from the Platzer planetary mill is from about 4 to 6 mm, usually about 6 mm. For a reduction from 6 mm to a desired thickness of 1.6 mm, the hot rolling four high millstands must effect an overall 74% reduction. (From a 4 mm Platzer mill exit thickness, a reduction of 55% would be necessary to obtain a 1.8 mm thickness.) A four (4) stand, hot rolling four-high millstand assembly is preferred to produce a 1.6 mm thickness strip with desired physical properties. The stands would make reductions, for example, of approximately the same amount in each of the first three (3) stands, with the last stand taking a relatively light reduction:

| Stand | Thickness In | Thickness Out | % Reduction |
|---|---|---|---|
| F1 | 6.0 mm | 3.8 mm | 37% |
| F2 | 3.8 mm | 2.55 mm | 33% |
| F3 | 2.55 mm | 1.8 mm | 30% |
| F4 | 1.8 mm | 1.6 mm | 12% |

For another example, in another preferred embodiment of the invention, the thickness of the endless slab on exit from the Platzer planetary mill is about 4 mm. For a reduction from 4 mm to a desired thickness of 0.8 mm, the hot rolling four high millstands must effect an overall 80% reduction. A four (4) stand, hot rolling four-high millstand assembly is again preferred to produce a 0.8 mm thickness strip with desired physical properties. The stands would make reductions, for example, of approximately the same amount in each of the first three (3) stands, with the last stand taking a relatively light reduction:

| Stand | Thickness In | Thickness Out | % Reduction |
|---|---|---|---|
| F1 | 4.0 mm | 2.4 mm | 40% |
| F2 | 2.4 mm | 1.45 mm | 40% |
| F3 | 1.45 mm | 0.94 mm | 35% |
| F4 | 0.94 mm | 0.8 mm | 15% |

The hot four-high millstands of the preferred embodiment of the invention may be configured to take a maximum reduction of about 95% of the output thickness from the Platzer planetary mill, with the use of additional millstands optionally included to serve a finishing function.

To avoid folding over of the edges of the as-continuously cast endless slab, an edge millstand, may preferably be employed to properly shape the side/lateral edges of the slab. The edge millstand will also close up any gas bubbles or other occlusions which form at or migrate to said edges. Alternatively, the continuous casting device may be fitted with a pre-shaped mold, which provides the endless slab with side/lateral edges shaped in a manner resistant to edge folding. The mold would provide a slab with side/lateral edges having, in cross section transverse to the casting direction, a generally flattened arcuate or elliptical shape, with no perpendicular corners.

A further preferred embodiment of the process and apparatus of the invention includes an edge induction reheater placed intermediate between the continuous casting device, and the homogenizing furnace. The edge induction reheater brings the as-continuously cast endless slab edges up to a 1,200–1,250° C. hot rolling temperature, compensating for the edge cooling resultant from the casting process itself.

It is particularly preferred to combine an edge millstand with an edge induction reheater. The edge millstand, which may further shape the edge, if edge shaping through the casting mold is not used, may also be used, if desired, to "edge in" the as-continuously cast endless slab, to make the resultant strip narrower to increase the life of the work rolls in the downstream hot rolling millstands.

The use of an edge induction reheater thus provides desired temperature homogeneity across the endless slab, avoiding edge cooling and accompanying difficulty with in-folding, tearing and non-uniformity. The combined use of an edge millstand with an edge induction reheater thus provides maximum run length for the process, by minimizing the cutting into or incising of the surface of the work rolls of the hot rolling millstands, usually caused by cold edges, and by allowing said slab narrowing to effect working on un-scored or incised work roll surface, when scoring does occur.

FIGS. 5A–D and 6A–D illustrate the preferred apparatus for edge profiling the continuously cast endless steel slab prior to introduction to the Platzer planetary mill.

Figures 5B, 5C, 5D:
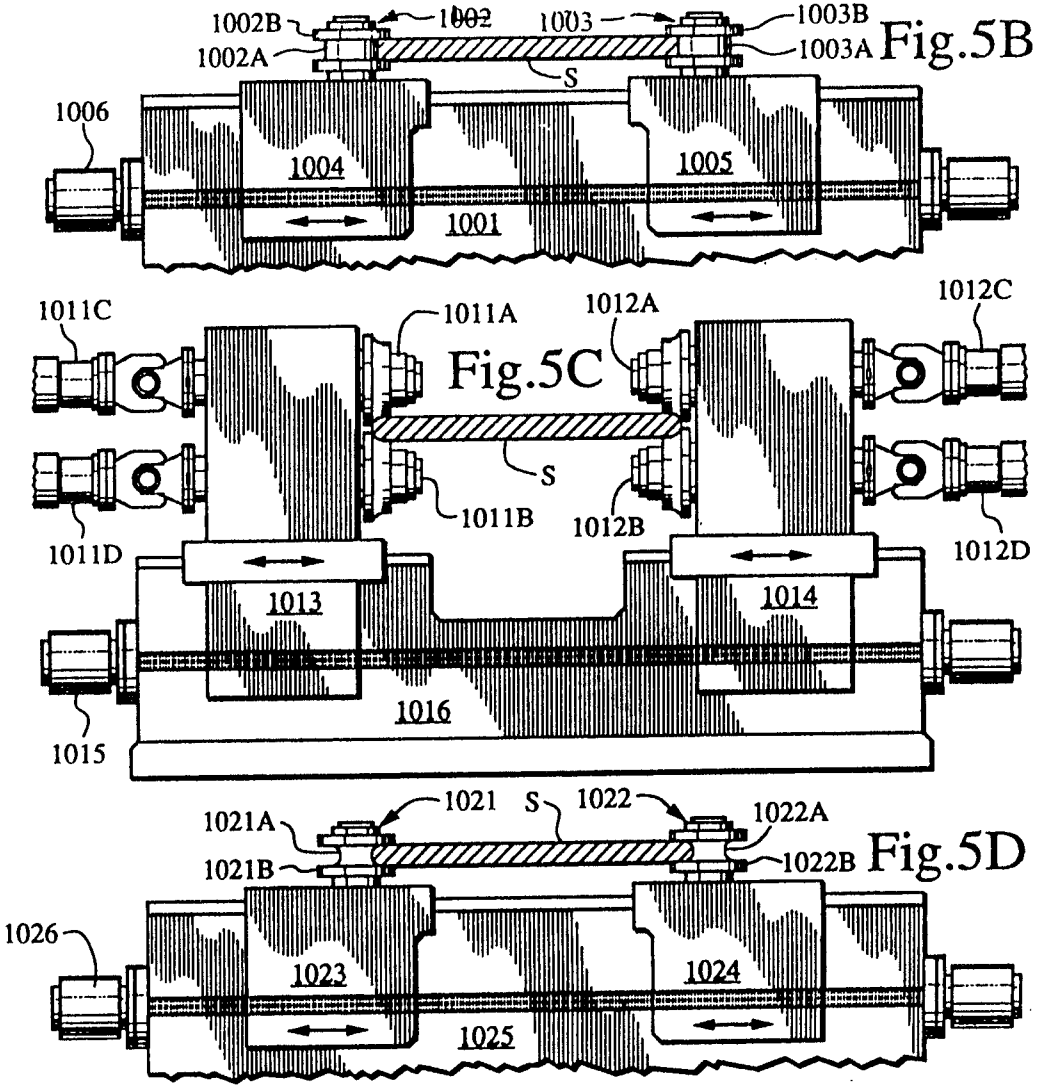
FIG. 5B is a cross-sectional view, taken at section lines 5B—5B, shown in FIG. 5A, of said edge millstand.
FIG. 5C is a cross-sectional view, taken at section lines 5C—5C, shown in FIG. 5A, of said edge millstand.
FIG. 5D is a cross-sectional view, taken at section lines 5D—5D, as shown in FIG. 5A, of said edge millstand.
Figure 5A:
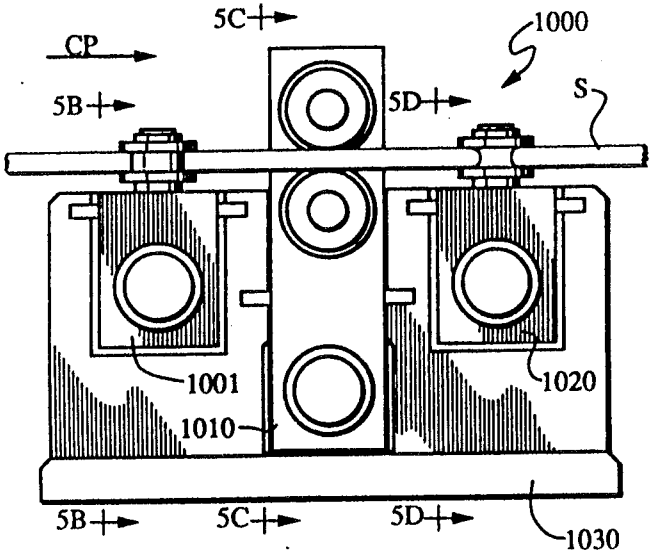
FIG. 5A is a side view of the edge millstand of one embodiment of the invention.

FIG. 5A. is a side view of the edge millstand 1000 which comprises the preferred apparatus for edge profiling. Generally, it is made up of three component units, feed support 1001, edge mill 1010 and output support 1020. The component units each are supported by base 1030, into which each is slidingly fitted and engaged in a locking/release arrangement. The slide fit allows removal of any one or all of the units from the casting line, by transverse motion out of the longitudinal casting path CP.

Feed support 1001 (FIG. 5B.) includes two support wheels 1002, 1003, which are journaled for rotation around axes perpendicular to the plane of the cast steel strip, and are supported by adjustment blocks 1004, 1005. Adjustment blocks 1004, 1005 in turn are in threaded engagement with adjustment drive 1006, and in sliding engagement with base 1001. Blocks 1004, 1005 are spaced equidistantly about the centerline of the continuous casting line, and, by rotation of adjustment drive 1006 by drive means not illustrated, the distance between support wheels 1002, 1003 can be adjusted to accommodate different casting widths of steel, and/or to narrow, by "edging in," the as-continuously cast width of the slab. The hubs 1002A, 1003A and flanges 1002B, 1003B of wheels 1002, 1003 are concentric and perpendicularly arrayed, such that no change in the as-cast, substantially right angle edges of the slab is caused by contact with said wheels. The hubs 1002A, 1003A, being of lesser diameter than flanges 1002B, 1003B, provide a channel, comprising the outward surface of said hubs and the inner walls of said flanges, in which the slab is carried.

Edge mill 1010 (FIG. 5C.) includes two pairs of driven mill rollers 1011A, B, 1012A, B driven by drive means not illustrated, supported by adjustment blocks 1013, 1014 respectively. Adjustment blocks 1013, 1014 in turn are in threaded engagement with adjustment drive 1015, and in sliding engagement with base 1016. Blocks 1013, 1014 are spaced equidistantly about the centerline of the continuous casting line and, by rotation of adjustment drive 1015, by drive means not illustrated, the distance between driven mill roller pairs 1011A, B and 1012A, B can be adjusted to accommodate different casting widths of steel, and/or to narrow or further narrow, by "edging in," the as-continuously cast width of the slab. Driven mill rollers 1011A, B and 1012A, B are horizontally journaled .in respective adjustment blocks 1013, 1014, and are rotated by drive means (not illustrated) drivingly attached to each of said rollers through respective universal joints 1011C, D and 1012C, D. The outer circumferential surfaces of each of roller pairs 1011A, B and 1012A, B are configured to provide the upper and lower portions of a desired edge profile to the steel S. By driven engagement with the steel S, the mill rollers convert the right angled edges, in transverse cross section, into shapes that eliminate edge folding and other undesirable defects when the strip thickness is reduced in the Platzer planetary mill 22 of the invention.

Output support 1020 (FIG. 5D) includes two support wheels 1021, 1022, which are journaled for rotation around axes perpendicular to the plane of the cast steel, and in turn supported by adjustment blocks 1023, 1024. Adjustment blocks 1023, 1024 are in threaded engagement with adjustment drive 1026, and in sliding engagement with base 1025. Blocks 1023, 1024 are spaced equidistantly from the centerline of the continuous casting line, and, by rotation of adjustment drive 1026 by drive means not illustrated, the distance between support wheels 1021, 1022 can be adjusted to accommodate different casting widths of steel, and/or to narrow or further narrow, by "edging in," the as-continuously cast width of the slab. The hubs 1021A, 1022A and flanges 1021B, 1022B of wheels 1021, 1022 are concentric, and have surfaces (the outer surface of the hubs, the inner walls of the flanges) which provide a shannel having substantially the edge configuration of the steel resulting from contact with edge mill 1010, such that substantially no change in the shape of the edges of the slab is caused by contact with said wheels.

Figures 6A, 6B, 6C, 6D:
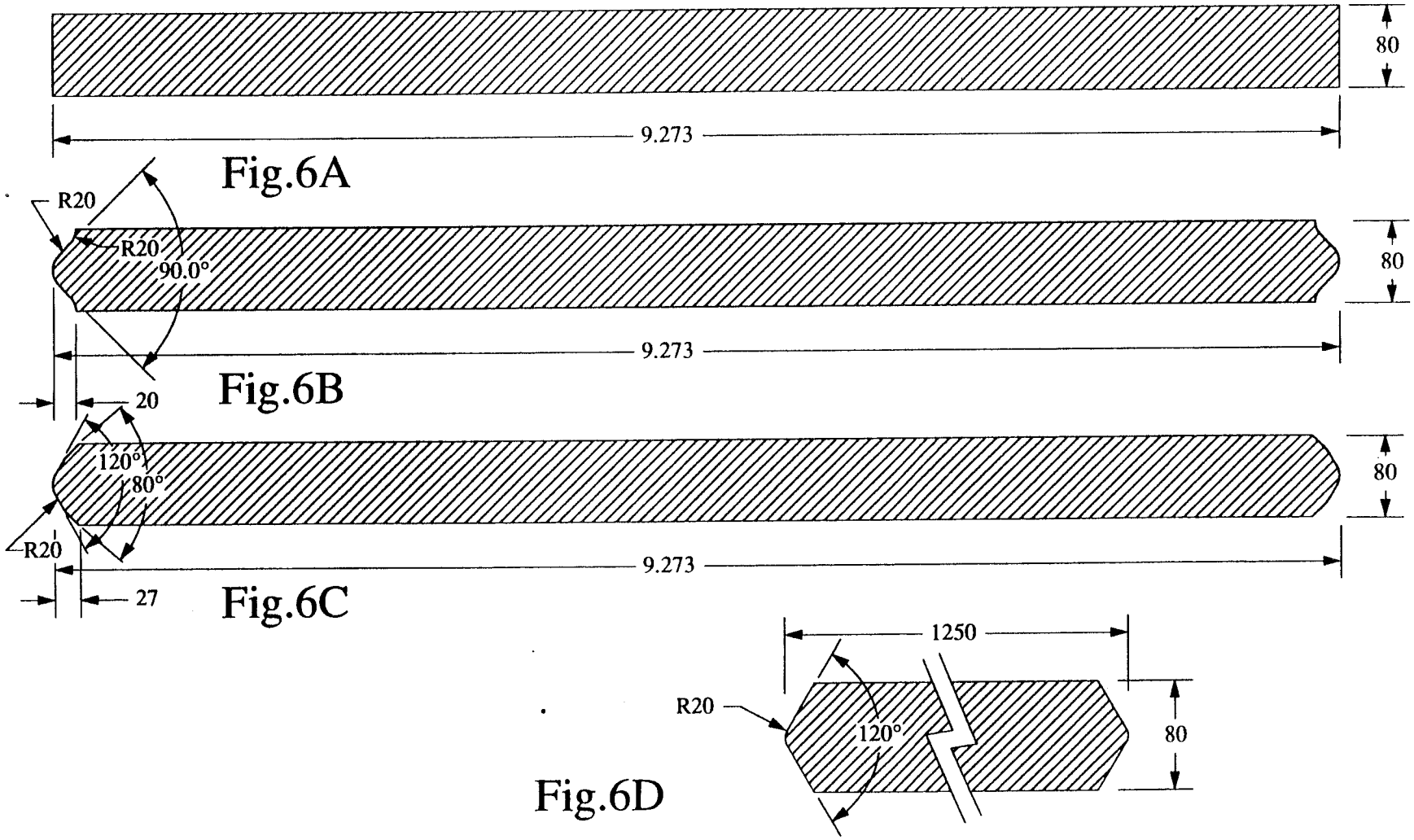
FIGS. 6A–D are a series of cross-sectional views of steel with various edge profiles, including edge profiles of the invention.

FIG. 6A-D illustrate several preferred embodiments of edge configuration for as-cast steel, which edge mill stand 1000 may provide. FIG. 6A. is the edge of the as-continuously cast steel, having substantially right angle edges in transverse section. (The direction of casting is perpendicular to the plane of FIGS. 6A-D). FIG. 6B. is one embodiment of an edge profile of the invention, providing an outwardly projecting, semicircular middle portion, equidistantly arrayed about the thickness centerline of the steel, but of diameter less than the thickness of steel S and, running from each side of said projecting middle portion, a shoulder portion, which forms a substantially perpendicular top and bottom edge with the top and bottom surfaces of the strip, and which make an included angle of about 90°. FIG. 6C. is another embodiment of an edge profile of the invention, providing an outwardly projecting, roughly semicircular cross-section. The cross section is a combined form having a semicircular portion equidistantly arrayed about the thickness centerline of the steel, from which continues, disposed about the centerline, first portions which make an included angle of about 80°, and, from which first portions in turn continue, about the centerline, second portions which make an included angle of about 120°, and which meet the top and bottom surfaces of the strip. The edge configuration of FIG. 6C. is particularly preferred where maximum reductions are sought. FIG. 6D. is yet another embodiment of an edge profile of the invention, providing an outwardly projecting, roughly triangular cross-section, whose apex is rounded and whose sides make an included angle of about 120°, and which meet the top and bottom surfaces of the strip.

Figure 7:
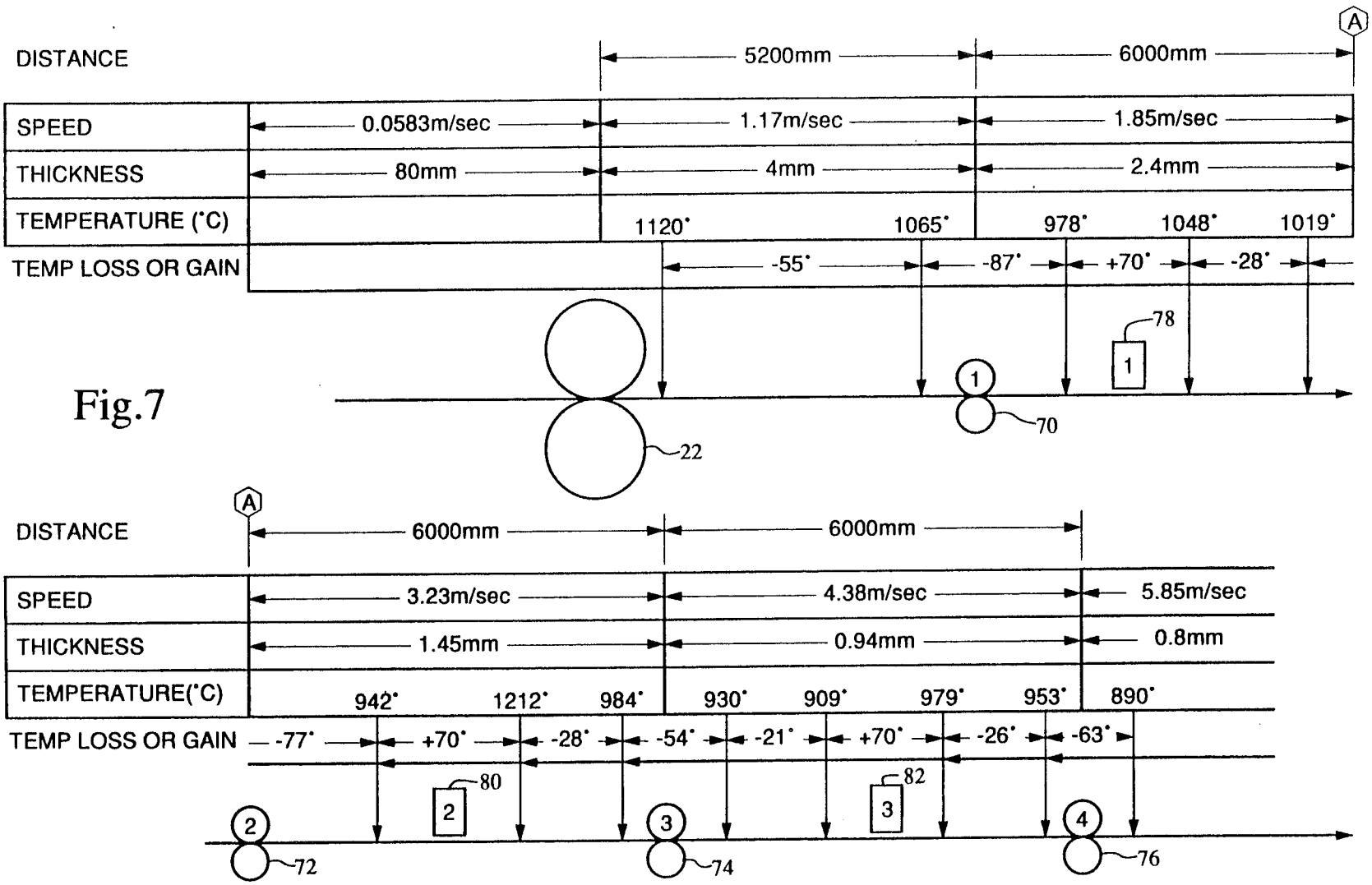
FIG. 7 is a flow diagram of one embodiment of the process illustrating the distance between stages, the thickness of the strip at each stage, the speed of movement of the strip at each stage, and the temperature of the strip at each stage.

FIG. 7 is a flow diagram of a particularly preferred embodiment of the process of the invention illustrating the distance between stages, the thickness of the thin hot steel strip 19 at each stage, the speed of movement of the steel strip 19 at each stage, and the temperature of the steel strip 19 at each stage, for a 1,000 mm wide strip resulting in strip having a thickness of 0.8 mm. In this embodiment, at the input to the Platzer planetary mill 22, the steel strip 19 has a thickness of 80 mm and may be moving at a speed of about 0.0583 meters per second or about 3 meters per minute. At the output of the Platzer planetary mill 22, the strip has been reduced to 4 mm in thickness and may be moving at a rate of about 1.17 meters per second. At the output of the first millstand 70, the strip has been reduced to a thickness of 2.4 mm and may be moving at a speed of 1.9 meters per second. At the output of the second millstand 72, the strip may be moving at 3.23 meters per second and has a thickness of 1.45 mm. At the output of the third millstand 74, the strip may be moving at the rate of 4.9 meters per second and has a thickness of 0.94 mm. Finally, at the output of the fourth millstand 76, the strip may be moving at 5.85 meters per second and has a thickness of 0.8 mm.

It will be noted that a distance of 5200 mm exists between the planetary mill 22 and the first millstand 70. Also, a distance of 6,000 mm separates each adjacent set of millstands 70, 72., 74 and 76. Further, the temperature of the continuous hot steel strip at the output of Platzer planetary mill 22 is about 1,120° C. and by the time it reaches the first millstand 70 it has cooled to about 1,065° C. On the output of the first millstand 70, the temperature has further reduced to about 978° C. First induction reheater 78 adds 70° C. to the strip and gives it a temperature of about 1,048° C. By the time the strip enters the second millstand 72, the temperature has decreased to about 1,019° C. At the output of the second millstand 72, the temperature has further reduced to about 942° C. The second induction reheater 80 adds 70° C. to the strip to raise it to a temperature of about 1,012° C. By the time the strip enters the third millstand 74, its temperature has been reduced to about 984° C. At the output of the third millstand 74, the temperature has been reduced to about 930° C. and as it moves to the third induction reheater 82 it has cooled to about 909° C. The third induction reheater 82 adds 70° C. and raises the temperature to about 979° C. That temperature further reduces to about 953° C. at the input of the fourth millstand 76. At the output of the fourth millstand 76 the strip has cooled to about 890° C.

Figure 8:
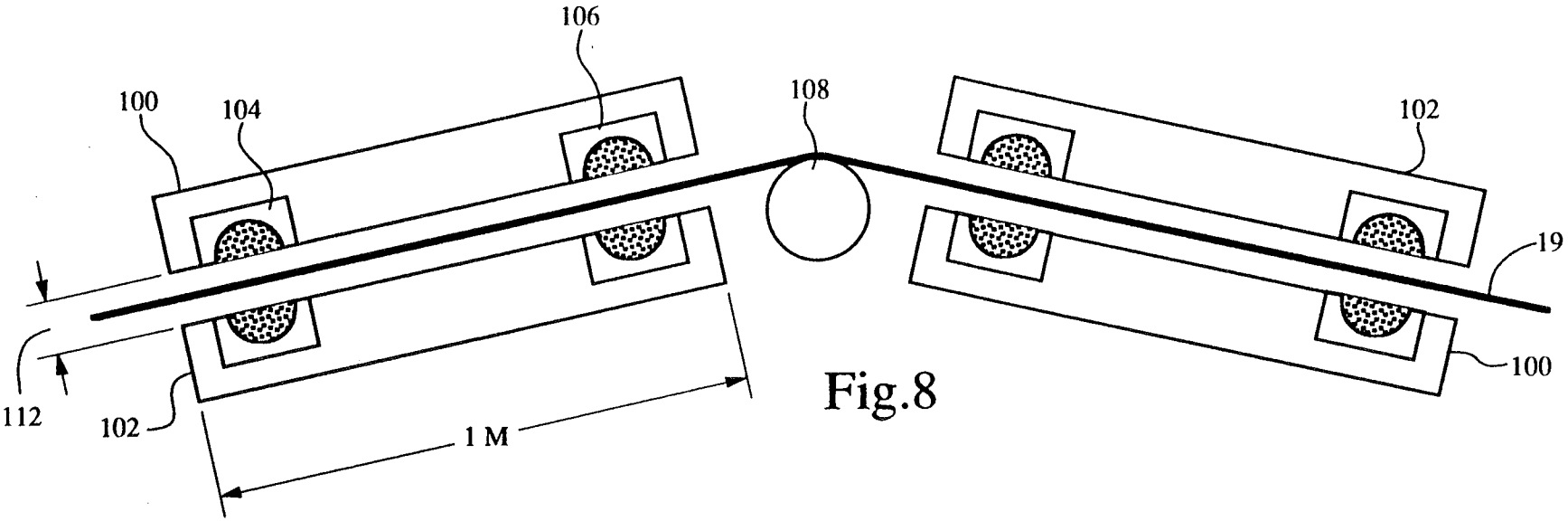
FIG. 8 is a diagrammatic representation of the construction of one of the electric induction heaters of the invention.

One of the electric induction reheaters 78, 80 and 82 is illustrated in FIG. 8. It is an electric inductor with a looper roller 108. The steel strip 19 passes two sets of inductor plates 100 and 102. The plates have a length of approximately 1 meter and have inductor coils 104 and 106 capable of producing 1,500 kilowatts to 2,000 kilowatts of energy. The distance 112 separating the inductors 100 and 102 is 50–75 mm. As the steel strip moves in its path between the two sets of inductors, it is heated approximately 70° C. to 100° C. before it is coupled to the next stage.

In a particularly preferred embodiment of the invention, temperature profiling of the running strip is carried out through use of the preheat means located upstream of the Platzer planetary mill, the edge reheater means, and/or the interstand induction reheaters located between each of the millstands. By use of known process control devices, including various computer-controlled means, and feedback, feedforward and/or other known process control techniques, a heat profile may be impressed on the continuous running strip by appropriate temperature settings, and maintained by the process control devices, for each individual preheat and/or reheat means. Product metallurgy is controlled and may be varied, on the running strip, if necessary, through these preheat, reheat and control means.

Figure 9:
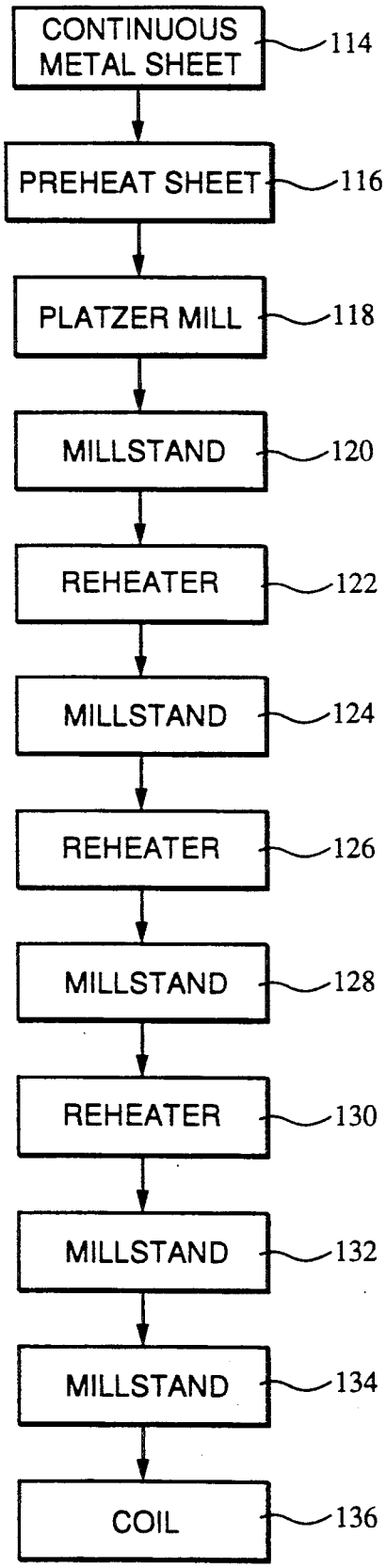
FIG. 9 is a flow chart illustrating the process of the present invention.

FIG. 9 illustrates the process steps of the invention. The continuous metal slab is formed at step 114 with the continuous endless thin slab casting device as explained earlier. The strip is preheated at step 116 and coupled to the Platzer planetary mill 118. The strip will normally have a thickness of approximately 80 mm as it enters the Platzer planetary mill at step 118. The Platzer planetary mill reduces the strip in thickness to a desired thickness such as 4, 6, 16 or 18 mm. With changes in strip thickness, the temperatures of the strip from the output of the Platzer planetary mill to the input of the last millstand will range from about 1,120° C. to about 825° C., preferably at least in excess of about the AC3 point of the particular steel involved. The strip is then coupled to a hot rolling millstand at step 120 where it is further reduced in thickness. A reheater at step 122 adds approximately 70° C.–100° C. to the strip and it is then coupled to a second millstand 124 where it is further reduced in thickness. At step 126, a second reheater adds further heat to the strip and it is then coupled to a third hot rolling millstand 128 where it is again reduced in thickness. At step 130, a third reheater again adds heat to the strip and it is then coupled to a fourth hot rolling millstand 132 for further reduction in thickness as desired. At steps 120, 124 and 128, the reduction in thickness ranges from about 10 to about 40%. At step 132, the reduction in thickness is between 8 and 15% based upon the reduction of the strip thickness from the immediately preceding millstand. At step 134, additional millstands as required may be used to flatten the strip and provide dimensional control with substantially no further thickness reduction. Further, at step 134 additional treatment may be provided as desired to give a commercially acceptable surface finish to the steel strip. At step 136, the strip is wound on a coil, cut to the proper size and prepared for shipment.

The initiation sequence of a continuous strip production run of the invention comprises the commencement of continuous casting through the continuous slab casting device. As is recognized in the art, a dummy bar or similar apparatus will be employed to start the continuous casting. As the initial continuously-cast endless slab comes out on the runout table, the dummy bar will be cut and removed, upwardly or downwardly, from the line. As continuous casting continues, the leading edge of the slab will contact pinch rolls upstream of the homogenizing furnace, and will feed through those rolls and then said furnace. With casting continuing, the leading edge of the endless slab will contact the drive rolls in the Platzer planetary mill, which will pick up and feed the slab into the mill. The Platzer planetary mill will then be closed down to the desired running thickness, with the strip speed accelerating downstream, as a result, into the first hot rolling millstand. In succession, each millstand will then be closed down to desired thickness as the strip enters the stand. Each of the intervening induction reheaters will then be brought in-line and closed about the strip. Optionally, a vertically adjustable roller table may be incorporated before the Platzer planetary mill to ease startup and to allow slab takeoff at the beginning and/or end of a continuous casting campaign. Through use of known cutting torch devices, the initial portion of the slab will be removed and scrapped, with the scrap recycled into the melt shop.

FIGS. 10A–F illustrate the threading sequence of the Platzer planetary mill and hot rolling millstands of the invention, with the as-continuously cast endless steel slab/strip.

Figure 10A:
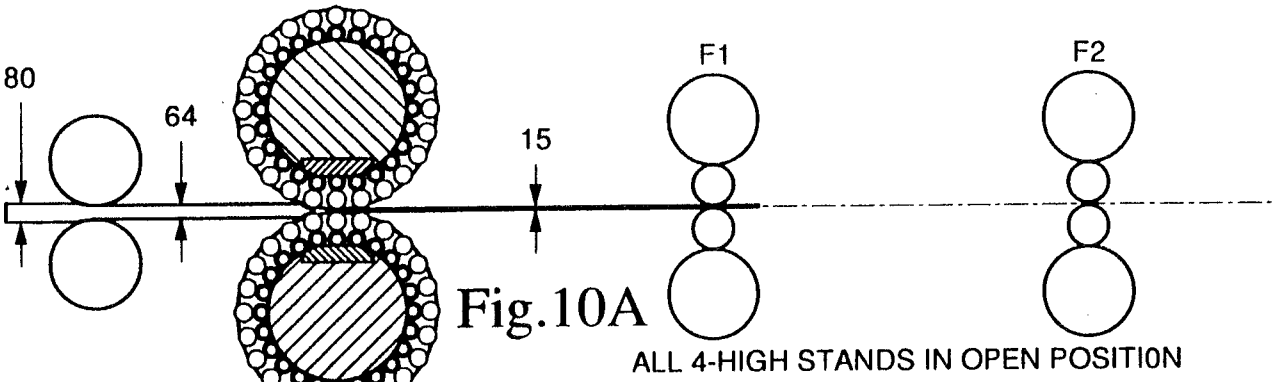
FIGS. 10A–F are a schematic representation of the threading sequence of the apparatus of the invention.

FIG. 10A. is the initial step in the sequence, and includes the Platzer planetary mill and the first two (2) of four (4) four-high millstands. All four (4) millstands begin the sequence in the open position, while the Platzer planetary mill is in a position intermediate between open and adjusted down to the intended running reduction. Feed pinch roller 2001 reduces the steel slab thickness from 80 mm to about 64 mm, which thickness may be readily force fed into the roll gap of the Platzer mill. Output strip thickness from the Platzer planetary mill is illustrated as 15 mm, which will vary dependent upon the openness of the Platzer roll gap.

Figure 10B:
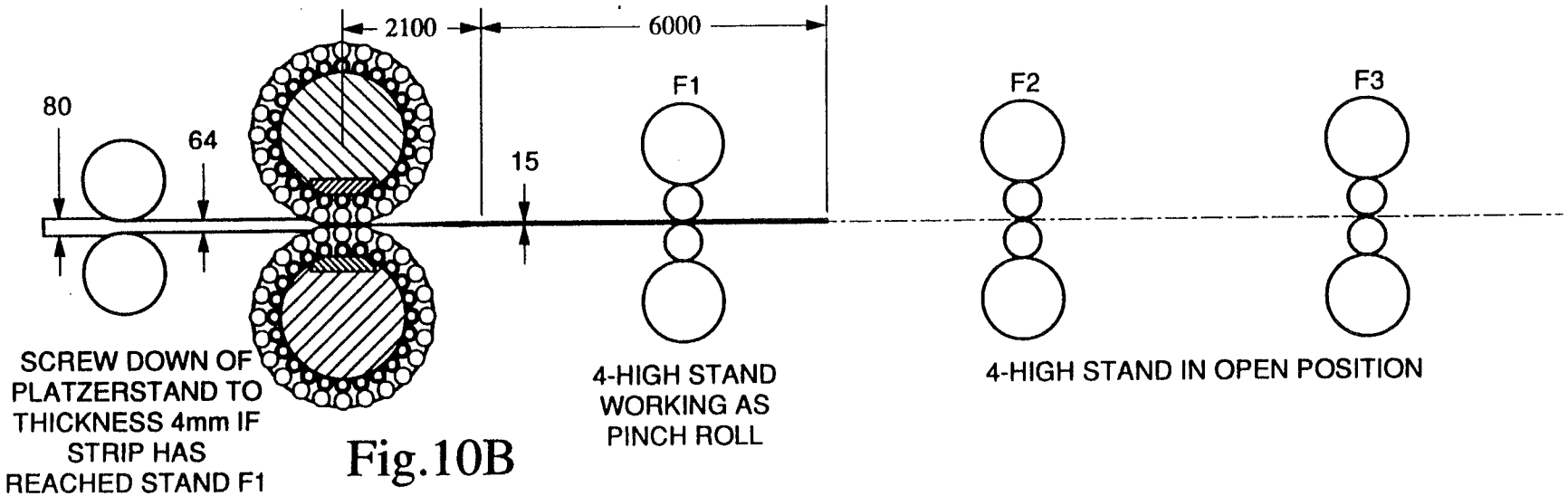

As the steel strip reaches the first four high millstand, Fl, screw down of the roll gap in the Platzer planetary mill has commenced, and continues until the intended running reduction is reached. As illustrated in FIG. 10B., the onset of screw down in the Platzer planetary mill is accompanied by the closing of four-high millstand Fl, which begins to function as a pinch roll as the work rolls are forced into contact with the running steel strip. Because the threading operation is only done once on each casting compaign, the Fl stand electric motor need only begin to take the work rolls up to its continuous, steady state running speed, without attempting to "zoom", in that heat loss is minimized from the continuously cast strip and preheat means. (Similarly, each of the motors of stands F2, F3 and F4 need only reach their continuous, steady state running speed).

Figure 10C:
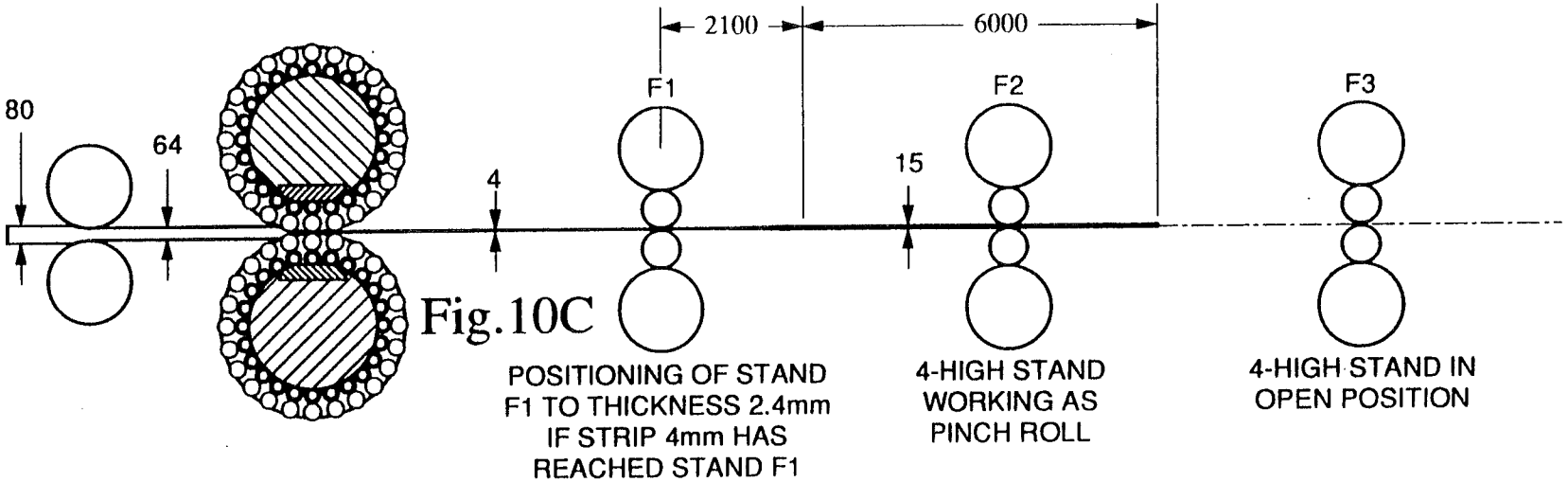

In FIG. 10C., the Platzer planetary mill is screwed down to running reduction, the output strip thickness being about 4 mm. The first four high stand, F1, is now closed down to running reduction which provides a 2.4 mm output thickness. The leading end of the strip has reached the second millstand, F2, which is shown in the process of closing. Again, F2, as Fl did previously, is functioning initially as a pinch roll, as the work rolls are forced into contact with the running steel strip.

Figure 10D:
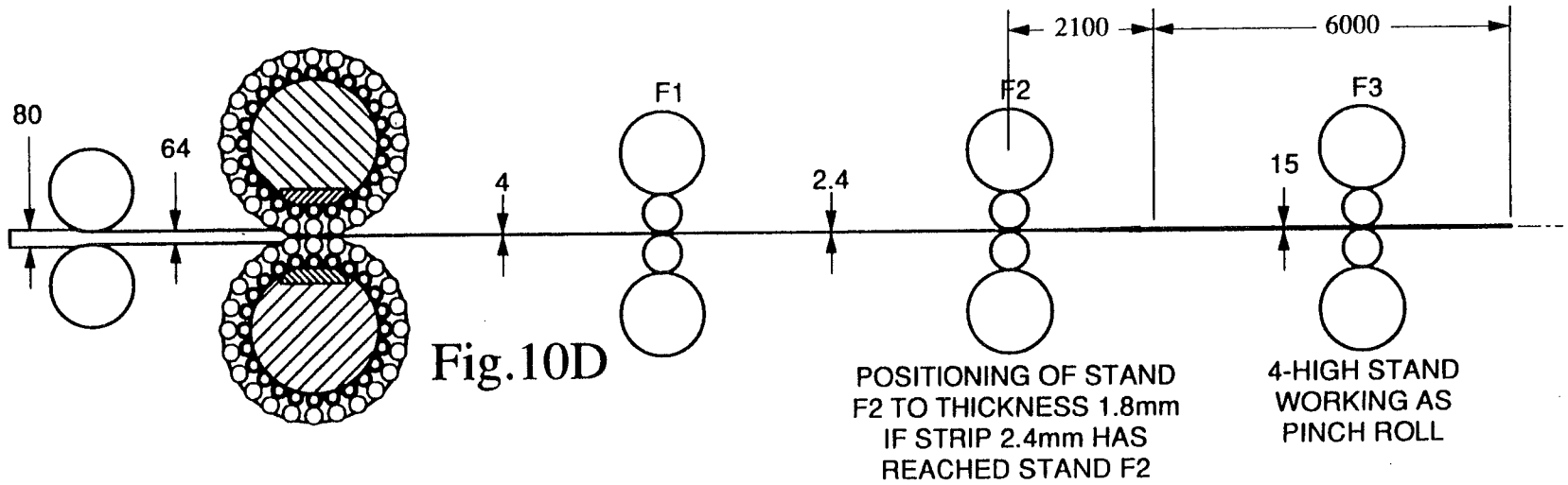

FIG. 10D. shows millstand F2 closed down to running reduction, which provides a 1.8 mm output thickness. The leading end of the strip has reached the third millstand, F3, which is shown in the process of closing. Again, F3, as F2 and F1 did previously, is functioning initially as a pinch roll, as the work rolls are forced into contact with the running steel strip.

Figure 10E:
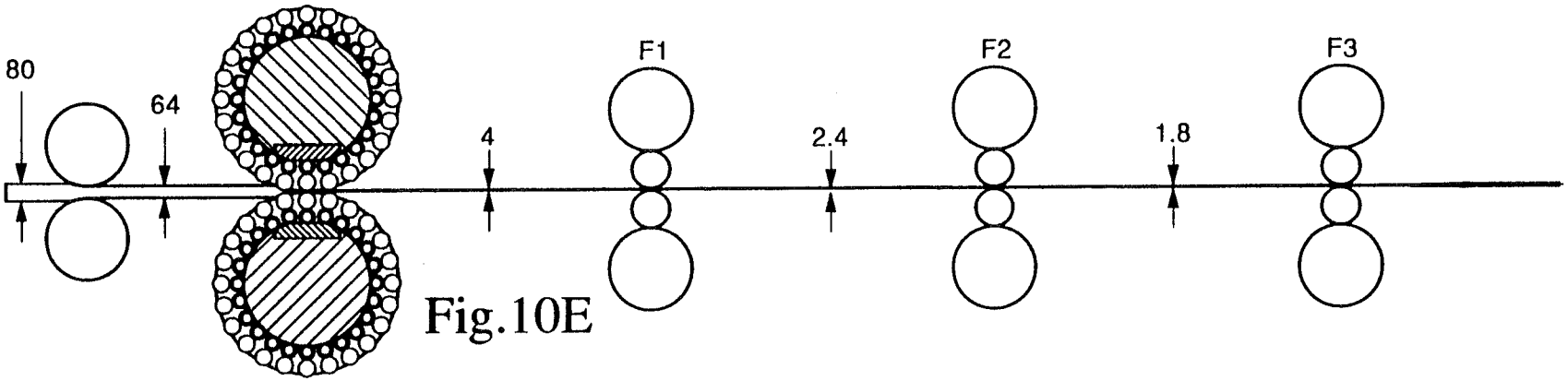
Figure 10F:
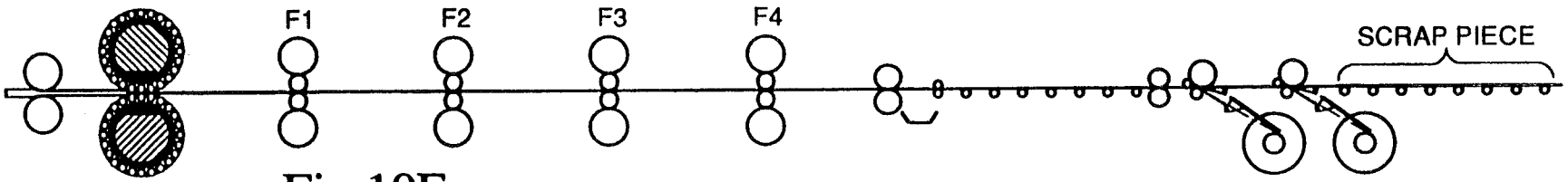

In FIG. 10E., millstand F3 is closed down to running reduction, which provides a 0.94 mm output thickness. Although not illustrated, the leading end of the strip is approaching the final millstand, F4, where the pinch roll to running reduction sequence is again followed, until F4 is closed to running reduction. FIG. 10F. shows the line with all four (4) four-high millstands threaded and the leading end of the strip severed, for recovery and recycling through the continuous caster.

The fully continuous operation of the preferred apparatus and process of the invention requires that the threading procedure illustrated in FIGS. 10A–F be practiced only once in each casting campaign.

Figures 11A, 11B:
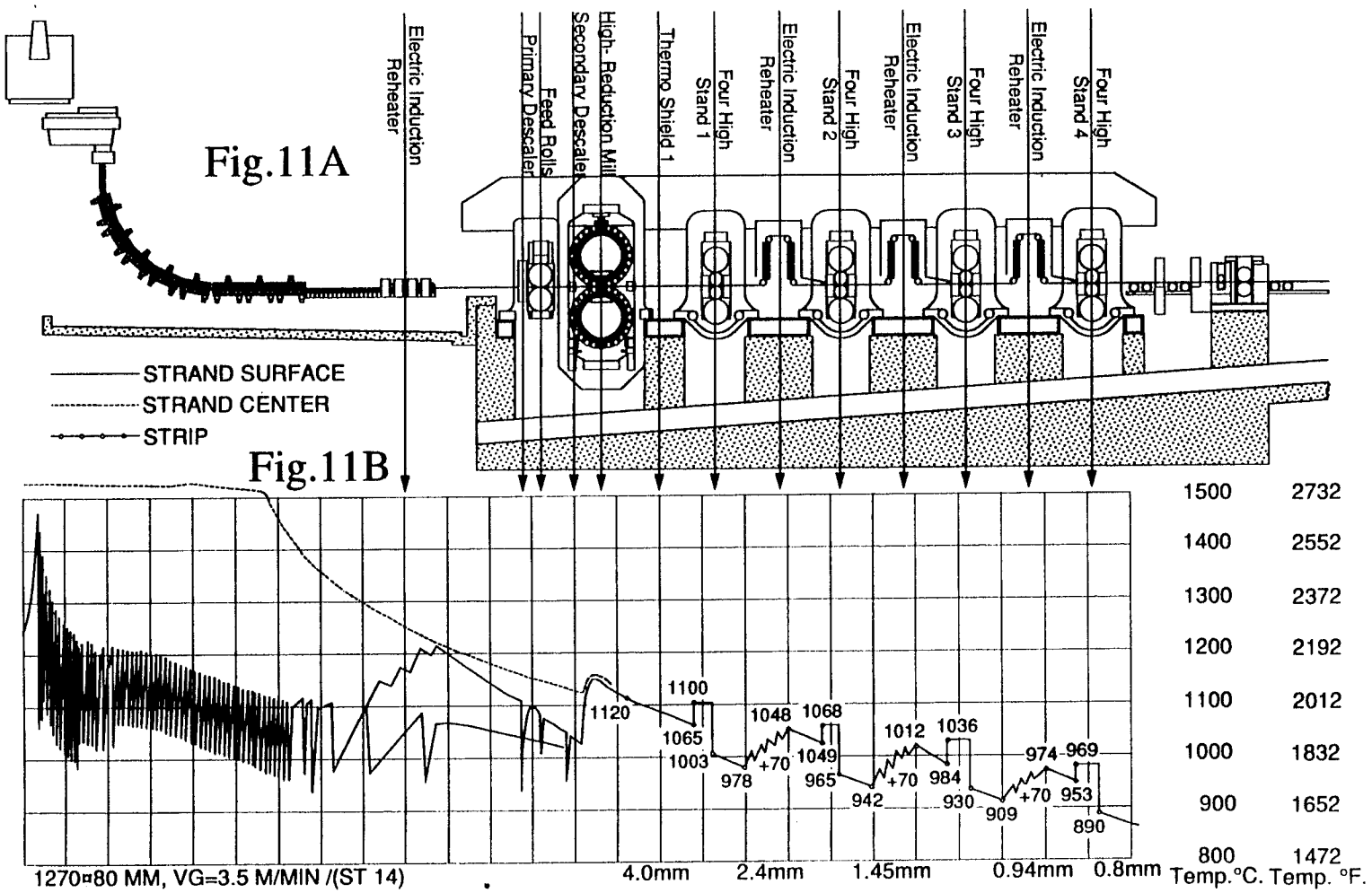
FIG. 11A–E are a second diagrammatic representation of a system and process for the present invention (FIGS. 11A or 11D and 11C, in sequence), including charts of expected temperatures of the strip at each stage of the process (FIG. 11B, at 3.5 m/min.
Figure 11C:
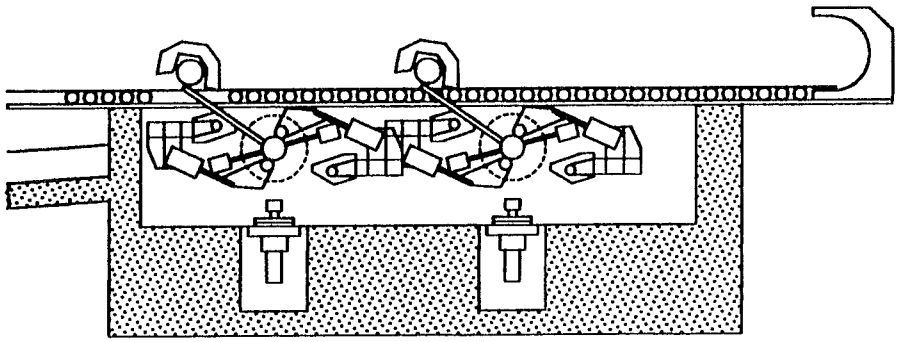
Figures 11D, 11E:
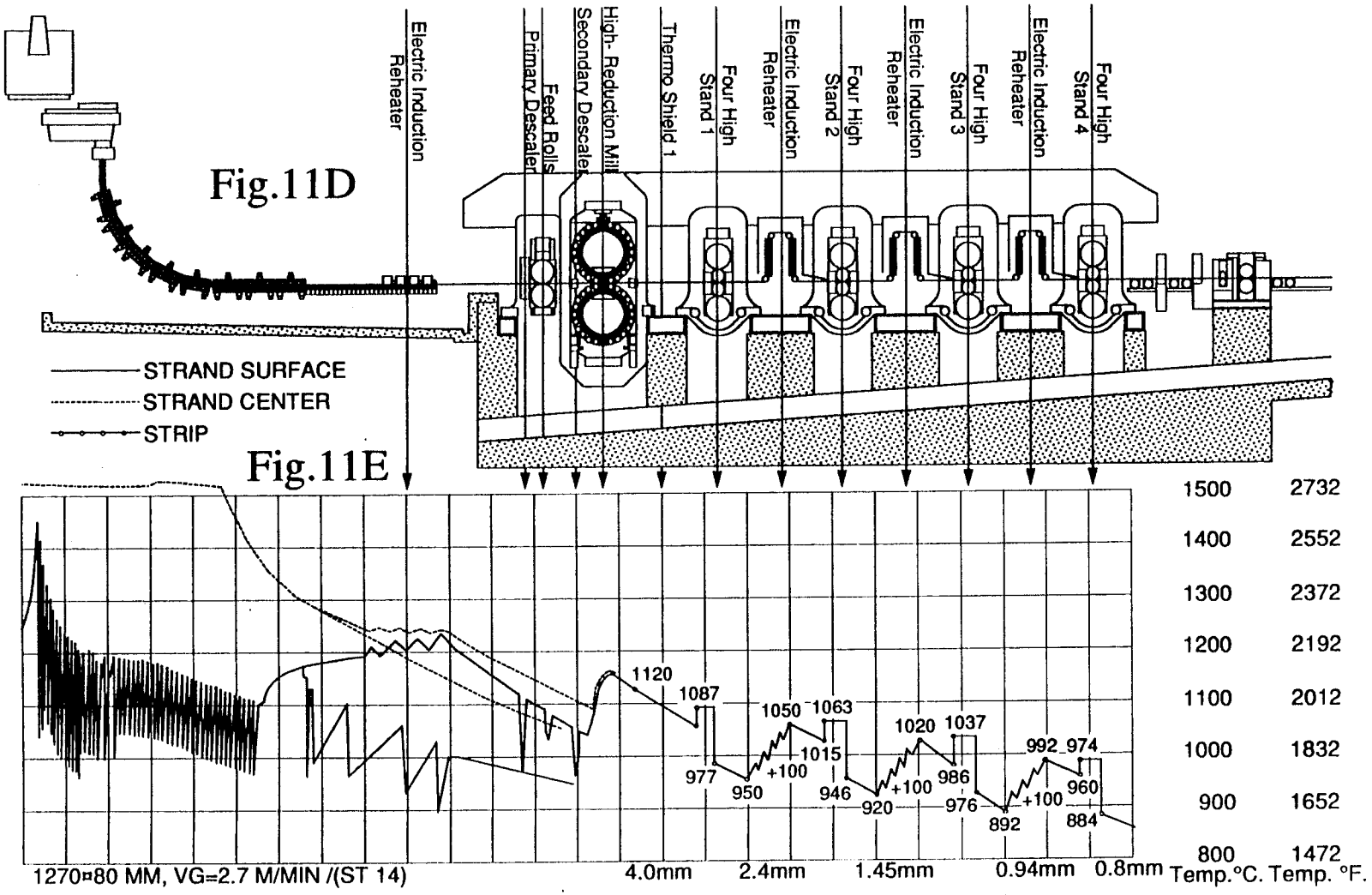

FIGS. 11A–E shows a second system and process of the invention, configured similarly to FIG. 4. The two charts in FIGS. 11A–B and 11E plot calculated temperatures for the strip at two different continuous casting-/running speeds. FIG. 11B illustrates calculated temperatures for a steel cast at 3.5 m/min, while FIG. 11E illustrates calculated temperatures for a steel cast at 2.7 m/min, for ultimate product strip having a thickness of 0.8 mm. (Both charts are calculated on the basis of 80 mm thick, 1,270 mm wide as-continuously cast slab, as fed to the feed rolls of the Platzer planetary mill). The interstand induction reheaters in the first calculation are adjusted to add approximately 70° C. between millstands, while those in the second are adjusted to add approximately 100° C. between millstands.

The hot rolling millstands of the invention may, in various preferred embodiments, use techniques known in the art for production of strip steel. These include the use of axial shifting and bending of the work rolls, which allow control of crowning of the endless strip while avoiding bad edges and sheet edge drop off as well (see FIGS. 3A–B). These techniques will all maximize the flatness of the strip steel, in turn enabling the end user of the product to go directly to manufacturing processes without further steps to prepare the steel strip.

While the use of four-high millstands is preferred, it is within the scope of the invention to use six-high millstands, or combinations of four-high and six-high millstands, dependent upon the level of reduction sought in the hot rolling portion of the process. Six-high millstands are able to take higher reductions than four-high millstands, but require a greater investment. Particularly preferred embodiments comprise all four-high millstands, with at least two (2) or three (3) stands in the process, or at least three (3) or more four-high millstands, followed by two six-high millstands, or a six-high millstand followed by at least two (2) four-high millstands.

The configuration of the process apparatus of the invention affords substantial savings in capital cost and operating expense of the hot rolling millstands, over prior art processes. In a conventional hot rolling mill, attaining a sheet thickness of 1.8 mm to 2.5 mm, at least six (6) reducing millstands, after a roughing millstand, for a total of seven (7) stands, are required. In a four-high millstand, the work roll diameters are generally governed by the gauge/thickness of the strip desired. A typical hot rolling mill requires the use of work roll diameters substantially larger in diameter than the rolls used in the hot rolling millstands of the invention. The work roll diameters are essentially the same herein as the work diameters used in conventional cold rolling millstands. A savings in capital costs is attained, then, in both obviating the need for a conventional cold rolling mill, and in using less massive and costly millstands in the hot rolling portion of the process.

The use of smaller work rolls in the hot millstands also reduces operating costs, by allowing the use of lower horsepower electrical motors in driving the stands.

To enable long continuous running of the casting line of the invention, the configuration of the preferred millstands shall preferably provide additional capabilities not available through apparatus and processes of the prior art, all directed to long run times without diminishing the physical properties of the thin hot rolled strip. The preferred millstands provide roll gap lubrication, to minimize wear and friction. The millstands are constructed to allow axial shifting (transverse to the casting and rolling direction) of the work rolls. In addition, in particular preferred millstands, roll changing during rolling of the running strip is possible which will allow the remaining millstands to take reductions while the stand being changed over is temporarily off line.

The principal capital and operating savings of the preferred embodiments of the invention, lie in the reduced number and size of millstands required to produce the desired thickness of thin hot steel strip. In a standard prior art process, the hot mill comprising a roughing mill and a finishing train would require 40,000 KW (installed) for strip 2.5 mm thick and 1,250 mm wide.

The substantial power requirements of each stand are a result of the fact that all known hot rolling mills are batch operations, which never attain a steady state condition. For each separate slab processed by the mill, the threading/closing of the mill/acceleration sequence of operations must be followed, which result in very poor utilization of electricity and oversizing of horsepower requirements of the electric motors driving the stands. When the mills are closed, the one closest to the caster is closed first, with each mill thereafter closed in sequence moving downstream in the process. As the mills are closed, they must be speeded up immediately, because of the length of the sheet and related temperature drop, from the tail end to the head or leading edge of the strip. The tail end is coldest, and will be subject to rolling last; because the millstands do not provide additional heat to the sheet, the tail end will continue to cool through the rolling operation which results in the necessity for the highest throughput speed possible in addition to whatever requirement exists because of the need to avoid firecracking the rolls, to enable practice of "zooming." This requires each millstand to always have sufficient horsepower to attain top speed, to continuously accelerate the line before the inherent temperature drop makes proper rolling of the strip impossible.

The invention with its combination of interstand reheating devices alternating with hot rolling millstands, avoids these conventional problems. Because the heaters and the fully continuous operation of the process avoid the temperature drop problem, there is no need to speed up and accelerate the hot rolling mill portion of the process. The fully continuous operation of the process plainly obviates the need to thread/close/"zoom" the hot rolling mill portion of the process, which the use of discrete slabs mandated. The result is that the process and devices of the invention allow more efficient use of electricity and scaling of the electric motors for the millstands, as constant rpm and horsepower for each millstand are used.

In a particularly preferred configuration of the Platzer planetary mill and four (4) four-high millstands of the invention, a total installed power of 20,000 kw will produce strip 0.8 mm thick and 1,250 mm wide. The savings in capital cost, 40,000 kw motor power installed [prior art] vs. 20,000 kw motor power installed [invention], and in operating expense is substantial, even without the savings of both capital and operating expense resulting from the lack of need for a cold rolling mill.

There has been disclosed, then, a novel system and process for forming thin flat hot rolled steel to a minimum thickness sufficient to go directly to product manufacture and which utilizes an as-continuously cast endless slab of steel. The novel system utilizes a Platzer planetary reduction mill and a plurality of millstands for receiving the strip from the Platzer planetary .mill and further reducing it in thickness, and includes induction reheaters between each of the millstands to add the necessary heat to the strip sheet to enable it to be processed by the succeeding millstand.

The Platzer planetary mill reduces the continuous slab from a thickness of about 80 mm to approximately 4 mm. The successive millstands effect a second reduction in thickness of at least about 50% of the first reduced thickness from the Platzer planetary mill such that the continuous strip has an average thickness of less than about 1.8 mm, most preferably 1 mm or less, optimally 0.7–0.8 mm. The induction reheaters between adjacent millstands add heat to the steel to maintain the steel strip at a working temperature sufficient to effect the second reduction. At least three (3) reducing millstands are preferably used to achieve the desired thickness, but more may be used if necessary. The final thickness of the sheet may be reduced to 0.7–0.8 mm. Each of the millstands will produce a range of thickness reduction of about 10 to about 40% of that received from the preceding millstand.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

We claim:

1. A continuous process for making flat hot rolled steel or ferrous metal having a thickness sufficient to allow substantially direct product manufacture therefrom, consisting essentially of the steps of:

feeding a continuously cast endless slab of steel or ferrous metal into a Platzer planetary mill to effect a first reduction in thickness from the as-continuously cast thickness of said slab to produce a continuous hot strip having a first reduced thickness;

sequentially receiving, without an intervening cooling step, said continuous hot strip from said Platzer planetary mill by a plurality of non-reversing millstands to effect a second reduction in thickness of at least about 50% of said first reduced thickness such that said continuous hot strip has an average thickness of less than about 1.8 mm; and reheating said continuous hot strip between adjacent millstands by reheating means located therebetween to maintain said continuous strip sheet at a working temperature sufficient to effect said second reduction in thickness.

2. A process as in claim 1 further including at least three millstands sequentially receiving the continuous strip and effecting the second reduction in thickness.

3. A process as in claims 1 or 2 wherein the millstands are of the type known as four-high millstands.

4. A process as in claims 1 or 2 further including the step of feeding the continuously cast steel slab into the Platzer planetary mill at the rate of 2.5 to 3.5 meters per minute.

5. A process as in claim 1 including the step of reducing the steel strip thickness to a final thickness of less than about 1 mm.

6. A process as in claim 1 including the step of reducing the steel strip thickness to a final thickness of about 0.8 mm.

7. A process as in claims 1, 2, 5 or 6 wherein the working temperature of the steel from the output of the Platzer planetary mill to the input of the last millstand ranges from about 1,120° C. to approximately the AC3 point thereof.

8. A process as in claims 1, 2, 5 or 6 wherein the reduction in thickness of the steel strip produced by each millstand is between about 10 and about 40%.

9. A process as in claim further comprising the step of coiling the finished strip for shipment.

10. A process as in claim 1, further comprising the steps of:

cutting the finished strip into selected lengths; and coiling said cut finished strip, wherein said selected length of said cut strip and the diameter of said cut strip coil is not limited by cast slab length.

11. A process as in claims 1, 2, 5 or 6 further comprising the step of preheating said continuous slab before introducing said slab into said Platzer planetary mill.

12. A process as in claims 1, 2, 5 or 6 wherein the maximum thickness of said continuously cast endless slab before introducing said slab into said Platzer planetary mill is in the range of from about 70 to about 90 mm.

13. A process as in claims 1, 2, 5 or 6 wherein said reheating means between adjacent millstands are electric induction reheating means.

14. A process as in claims 1, 2, 5 or 6 wherein said Platzer planetary mill comprises at least one shaped stationary back-up beam means, whereby the orbiting work rolls and said stationary back-up beam means in combination effect profile and shape control to said continuous hot strip.

15. A system for making flat, hot rolled steel or ferrous metal strip having a thickness sufficient to allow substantially direct product manufacture therefrom, consisting essentially of:

a Platzer planetary mill for receiving a continuously cast endless slab of steel or ferrous metal to effect a first reduction in thickness from the as-continuously cast thickness of said slab to produce a continuous hot strip having a first reduced thickness;

a plurality of non-reversing millstands for sequentially receiving said continuous hot strip from said Platzer planetary mill, without intervening cooling means, to effect a second reduction in thickness of at least about 50% of said first reduced thickness such that said continuous hot strip has an average thickness of less than about 1.8 mm; and reheating means located between adjacent millstands for maintaining said continuous steel strip at a working temperature sufficient to effect said second reduction.

16. A system as in claim 15 where at least three millstands are used sequentially to provide said second reduction in thickness.

17. A system as in claims 15 or 16 wherein the millstands are of the type known as four-high millstands.

18. A system as in claims 15 or 16 wherein the continuously cast slab is fed into the Platzer mill at the rate of 2.5–3.5 meters per minute.

19. A system as in claim 15 wherein the said millstands provide a final thickness of said steel strip of less than about 1 mm.

20. A system as in claim 15 wherein said millstands provide a final thickness of said steel strip of about 0.8 mm.

21. A system as in claims 15, 16, 19 or 20 wherein the working temperature of said steel between the output of the Platzer planetary mill and the input to the final millstand ranges from about 1,120° C. to approximately the AC3 point thereof.

22. A system as in claims 15, 16, 19 or 20 wherein each millstand provides a range of reduction in thickness of about 10% and about 40%.

23. A system as in claim 15 further comprising means for coiling the finished strip for shipment.

24. A system as in claim 15 further comprising:

means for cutting the finished strip into selected lengths; and means for coiling said cut finished strip, said system providing selection of length of said cut strip and the diameter of said cut strip coil without being limited by cast slab length.

25. A system as in claim 15 further comprising preheating means for preheating said continuous slab before introducing said slab into said Platzer planetary mill.

26. A system as in claim 15 wherein said reheating means between adjacent millstands are electric induction reheating means.

27. A system as in claim 15 wherein said Platzer planetary mill comprises at least one shaped stationary back-up beam means whereby the orbiting work rolls and said stationary back-up beam means in combination apply profile and shape control to said continuous hot strip.

* * * * *